US010488793B2

(12) United States Patent
Sako et al.

(10) Patent No.: US 10,488,793 B2
(45) Date of Patent: Nov. 26, 2019

(54) IMAGE HEATING APPARATUS AND IMAGE FORMING APPARATUS FOR CONTROLLING A TEMPERATURE OF A FIRST HEATING ELEMENT AND A SECOND HEATING ELEMENT

(71) Applicant: CANON KABUSHIKI KAISHA, Tokyo (JP)

(72) Inventors: Masato Sako, Susono (JP); Atsushi Iwasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/214,777

(22) Filed: Dec. 10, 2018

(65) Prior Publication Data

US 2019/0107801 A1 Apr. 11, 2019

Related U.S. Application Data

(63) Continuation of application No. 15/632,874, filed on Jun. 26, 2017, now Pat. No. 10,185,258.

(30) Foreign Application Priority Data

Jul. 1, 2016 (JP) ..... 2016-131564

(51) Int. Cl.
*G03G 15/20* (2006.01)

(52) U.S. Cl.
CPC ..... *G03G 15/2042* (2013.01); *G03G 15/205* (2013.01); *G03G 15/2007* (2013.01); *G03G 15/2039* (2013.01); *G03G 15/2053* (2013.01); *G03G 2215/00805* (2013.01); *G03G 2215/209* (2013.01)

(58) Field of Classification Search
CPC ..... G03G 15/2042; G03G 15/2039; G03G 15/2053; G03G 15/2007; G03G 15/205; G03G 2215/209; G03G 2215/00805
See application file for complete search history.

(56) References Cited

U.S. PATENT DOCUMENTS 5,402,211 A 3/1995 Yoshikawa
5,546,173 A 8/1996 Hinotani et al.
(Continued)

FOREIGN PATENT DOCUMENTS

JP H06-95540 A 4/1994
JP 2013-041118 A 2/2013
(Continued)

*Primary Examiner* — G. M. A Hyder
(74) *Attorney, Agent, or Firm* — Venable LLP

(57) ABSTRACT

An image heating apparatus includes first and second heat generating elements arranged adjacent to each other, and a control portion that controls power supplied to the first and second heat generating elements, and that is capable of individually controlling the first and second heat generating elements, the first and second heat generating elements being respectively controlled so as to maintain a control temperature. When an image exists in a second region on the recording material heated by the second heat generating element, and an image does not exist in a first region on the recording material heated by the first heat generating element, the control portion sets the control temperature of the second heat generating element, when heating the second region, in accordance with a distance between an end section of the image in the second region and a boundary of the first region and the second region.

17 Claims, 16 Drawing Sheets

(56) References Cited

U.S. PATENT DOCUMENTS

| | | | |
|---|---|---|---|
| 7,193,181 | B2 | 3/2007 | Makihira et al. |
| 7,283,145 | B2 | 10/2007 | Kato et al. |
| 9,091,974 | B2 | 7/2015 | Yoshioka et al. |
| 9,122,212 | B2 | 9/2015 | Fujimoto et al. |
| 9,335,709 | B2 | 5/2016 | Iwasaki et al. |
| 9,377,727 | B2 | 6/2016 | Yoshioka et al. |
| 9,389,553 | B2 | 7/2016 | Yamamoto et al. |
| 9,568,867 | B2 | 2/2017 | Yoshioka et al. |
| 9,665,048 | B2 | 5/2017 | Iwasaki et al. |
| 2009/0148207 | A1 | 6/2009 | Yamada et al. |
| 2014/0219696 | A1 | 8/2014 | Fujimoto et al. |
| 2015/0331372 | A1 | 11/2015 | Takagi |
| 2018/0004134 | A1 | 1/2018 | Nomura et al. |
| 2018/0004136 | A1 | 1/2018 | Iwasaki |

FOREIGN PATENT DOCUMENTS

| | | | |
|---|---|---|---|
| JP | 2014-153504 | A | 8/2014 |
| JP | 2014-153507 | A | 8/2014 |
| JP | 2015-052722 | A | 3/2015 |
| JP | 2015-197653 | A | 11/2015 |

FIG. 8

| | $H_{(1,2)}$ | $H_{(2,2)}$ | $H_{(3,2)}$ | $H_{(4,2)}$ | $H_{(5,2)}$ | $H_{(6,2)}$ | $H_{(7,2)}$ | TOTAL |
|---|---|---|---|---|---|---|---|---|
| SUPPLIED POWER IN COMPARATIVE EXAMPLE 2 [W] | 47.9 | 59.6 | 59.6 | 59.6 | 59.6 | 47.9 | 47.9 | 382.1 |
| SUPPLIED POWER IN EXAMPLE 1 [W] | 47.9 | 59.6 | 59.6 | 60.7 | 47.9 | 47.9 | 47.9 | 371.4 |

FIG. 15

| | $A_{(1)}$ | $A_{(2)}$ | $A_{(3)}$ | $A_{(4)}$ | $A_{(5)}$ | $A_{(6)}$ | $A_{(7)}$ | TOTAL | POWER SAVING EFFECT |
|---|---|---|---|---|---|---|---|---|---|
| SUPPLIED POWER IN COMPARATIVE EXAMPLE 2 [W] | 59.6 | 59.6 | 59.6 | 59.6 | 59.6 | 47.9 | 47.9 | 393.8 | 0.0 |
| SUPPLIED POWER IN EXAMPLE 2 [W] | 47.9 | 60.2 | 59.6 | 60.7 | 47.9 | 47.9 | 47.9 | 371.9 | 21.9 |

IMAGE HEATING APPARATUS AND IMAGE FORMING APPARATUS FOR CONTROLLING A TEMPERATURE OF A FIRST HEATING ELEMENT AND A SECOND HEATING ELEMENT

This application is a continuation of U.S. patent application Ser. No. 15/632,874, filed Jun. 26, 2017, which claims the benefit of Japanese Patent Application No. 2016-131564, filed Jul. 1, 2016, both of which are hereby incorporated by reference herein in their entireties.

BACKGROUND OF THE INVENTION

Field of the Invention

The present invention relates to an image forming apparatus, such as a copying machine or a printer, that uses an electrophotographic system or an electrostatic recording system. The present invention also relates to an image heating apparatus, such as a fixing unit mounted on an image forming apparatus, and a gloss applying apparatus that heats the toner image fixed on a recording material again in order to improve the gloss level of the toner image.

Description of the Related Art

A system that selectively heats an image portion formed on a recording material in an image heating apparatus, such as a fixing unit, and a gloss applying apparatus used in an electrophotographic image forming apparatus (hereinafter, an image forming apparatus), such as a copying machine or a printer, has been proposed in order to meet demands for power saving, as described in Japanese Patent Application Laid-open No. H6-95540. In this system, a plurality of divided heating regions are set in a direction orthogonal to a conveying direction of the recording material (hereinafter, a longitudinal direction) is set, and a plurality of heat generating elements for heating the respective heating regions are provided in the longitudinal direction. In addition, based on the image information of the image formed in each heating region, the heat generating quantity of a corresponding heat generating element is controlled. For example, among the respective heating regions, a control temperature of a region without an image (hereinafter, a non-image heating section) is set lower than a control temperature of a region including an image (hereinafter, an image heating section).

In this case, with a configuration in which a heating region is divided in the longitudinal direction, there is a possibility that a temperature gradient due to a difference between the control temperatures of a non-image heating section and an image heating region adjacent thereto may occur in a vicinity of a boundary position of the non-image heating section and the image heating region. As a result, there is a possibility that a fixing failure or a gloss decrease may occur in a vicinity of an image end section on a side of a boundary position in the image heating section adjacent to the non-image heating section. In consideration thereof, Japanese Patent Application Laid-open No. 2015-52722 proposes a system that changes the heat generating quantity of the non-image heating section adjacent to the boundary position in accordance with a distance in the longitudinal direction between the boundary position and the image end section in the image heating section.

With the system disclosed in Japanese Patent Application Laid-open No. 2015-52722, however, since power supplied to the non-image heating section increases depending on a distance between a boundary position with the non-image heating section and an image end section in the image heating section, there is a possibility that a power saving effect may decline.

SUMMARY OF THE INVENTION

An object of the present invention is to provide a technique that enables a further power saving effect to be produced while suppressing occurrences of the fixing failure and the gloss decrease in a vicinity of an image end section.

In order to achieve the object described above, one aspect of the present invention provides an image heating apparatus that heats an image formed on a recording material. The image heating apparatus includes a first heat generating element, a second heat generating element that is arranged adjacent to the first heat generating element in a direction orthogonal to a conveying direction of the recording material, and a control portion that controls power supplied to the first and second heat generating elements, the control portion being capable of individually controlling the first and second heat generating elements. The first and second heat generating elements are respectively controlled so as to maintain a control temperature, and when an image exists in a second region on the recording material heated by the second heat generating element but an image does not exist in a first region on the recording material heated by the first heat generating element, the control portion sets the control temperature of the second heat generating element when heating the second region, in accordance with a distance between an end section of the image in the second region and a boundary of the first region and the second region.

Further, in order to achieve the object described above, another aspect of the present invention provides an image forming apparatus that includes an image forming portion that forms an image on a recording material, and a fixing portion that fixes the image formed on the recording material to the recording material, wherein the fixing portion is the image heating apparatus.

Further features of the present invention will become apparent from the following description of exemplary embodiments with reference to the attached drawings.

BRIEF DESCRIPTION OF THE DRAWINGS

FIG. 8 is a table showing power consumption by heating sections and a sum of power consumption according to a Comparative Example 2 and Example 1.

FIG. 15 is a table showing power consumption by heating sections and a sum of power consumption according to the Comparative Example 2 and Example 2.

DESCRIPTION OF THE EMBODIMENTS

Hereinafter, a description will be given, with reference to the drawings, of embodiments of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Example 1

1. Configuration of Image Forming Apparatus

Figure 1:
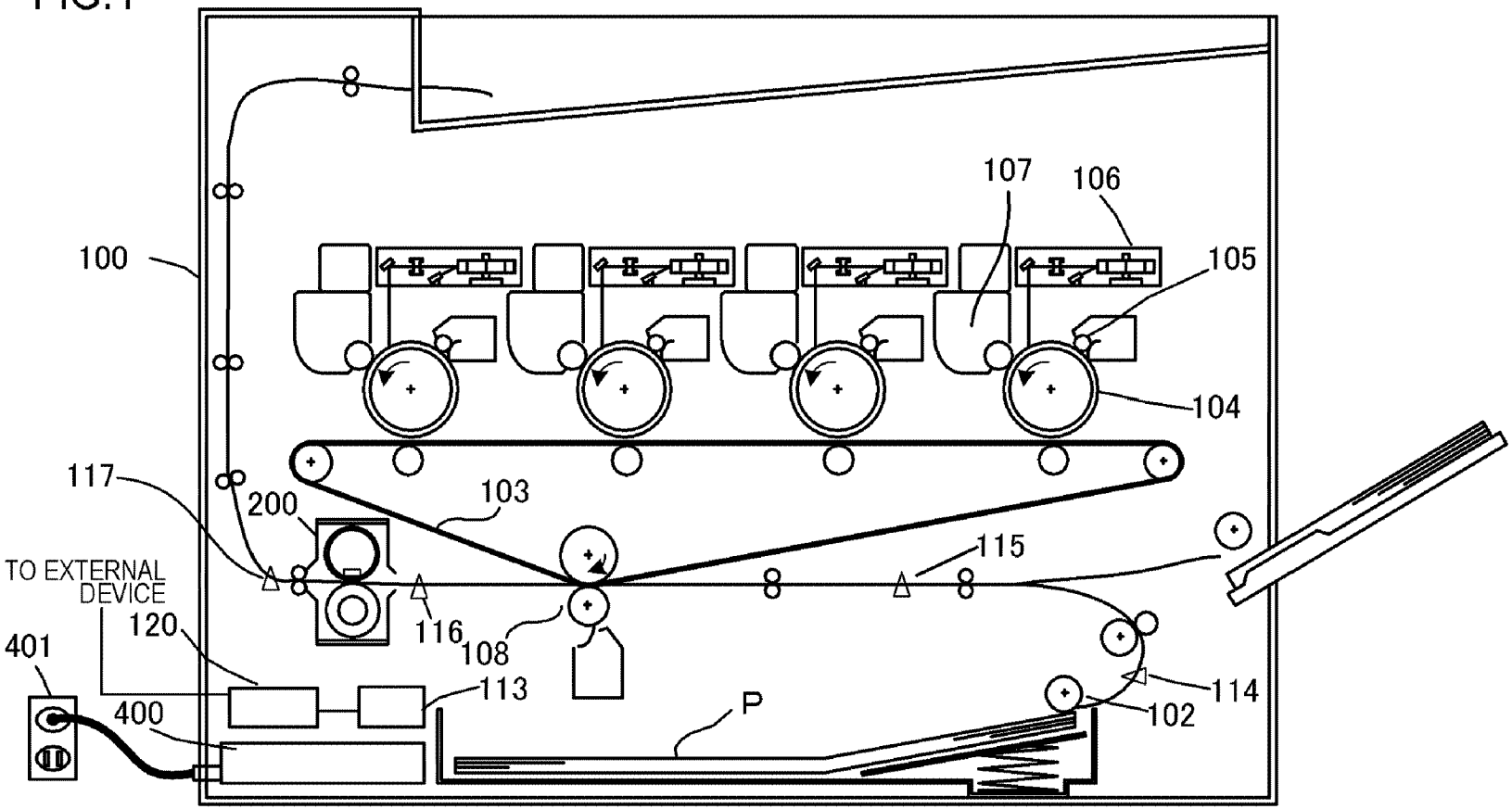
FIG. 1 is a sectional view of an image forming apparatus according to an embodiment of the present invention.

FIG. 1 is a configuration diagram of an image forming apparatus adopting an electrophotographic system according to an embodiment of the present invention. Examples of image forming apparatuses to which the present invention is applicable include copying machines, printers, and the like that utilize an electrophotographic system or an electrostatic recording system, and a case in which the present invention is applied to a laser printer will be described below.

An image forming apparatus 100 includes a video controller 120 and a control portion 113. As an acquiring portion that acquires information on an image formed on a recording material, the video controller 120 receives and processes image information and print instructions transmitted from an external apparatus, such as a personal computer. The control portion 113 is connected to the video controller 120 and controls respective units constituting the image forming apparatus 100 in accordance with instructions from the video controller 120. When the video controller 120 receives a print instruction from the external apparatus, image formation is executed through the following operations.

The image forming apparatus 100 feeds a recording material P with a feeding roller 102 and conveys the recording material P toward an intermediate transfer member 103. A photosensitive drum 104 is rotationally driven counter-clockwise at a predetermined speed by power of a drive motor (not shown) and is uniformly charged by a primary charger 105 during the rotation process. A laser beam modulated in correspondence with an image signal is output from a laser beam scanner 106 and performs selective scanning exposure on the photosensitive drum 104 to form an electrostatic latent image. Reference numeral 107 denotes a developing device that causes powder toner as a developer to adhere to the electrostatic latent image to make the electrostatic latent image visible as a toner image (a developer image). The toner image formed on the photosensitive drum 104 is primarily transferred onto the intermediate transfer member 103 that rotates while in contact with the photosensitive drum 104.

In this case, one each of the photosensitive drum 104, the primary charger 105, the laser beam scanner 106, and the developing device 107 is arranged for each of the four colors of cyan (C), magenta (M), yellow (Y), and black (K). Toner images corresponding to the four colors are sequentially transferred onto the intermediate transfer member 103 so as to overlap with one another by a same procedure. The toner images transferred onto the intermediate transfer member 103 are secondarily transferred onto the recording material P by a transfer bias applied to a transfer roller 108 at a secondary transfer portion formed by the intermediate transfer member 103 and the transfer roller 108. The configuration related to the formation of an unfixed image on the recording material P described above corresponds to the image forming portion according to the present invention. Subsequently, the toner images are fixed when a fixing apparatus 200 as an image heating apparatus applies heat and pressure to the recording material P and the recording material P is discharged to the outside as an image-formed article.

Moreover, the image forming apparatus 100 according to the present embodiment has a processing speed of 210 mm/sec. In addition, a distance from a rear end of a sheet of the recording material P on which an image has been formed to a front end of a sheet of the recording material P on which image formation is to be performed next is 35.6 mm. For example, when consecutively printing sheets of LETTER size paper, a throughput of 40 ppm (pages per minute) can be realized. The control portion 113 manages a conveyance state of the recording material P using a conveyance sensor 114, a resist sensor 115, a pre-fixing sensor 116, and a fixing discharge sensor 117 arranged on a conveyance path of the recording material P. In addition, the control portion 113 includes a storage unit that stores a temperature control program and a temperature control table of the fixing apparatus 200. A control circuit 400 as heater driving means connected to a commercial AC power supply 401 supplies power to the fixing apparatus 200.

2. Configuration of Fixing Apparatus (Fixing Portion)

Figure 2:
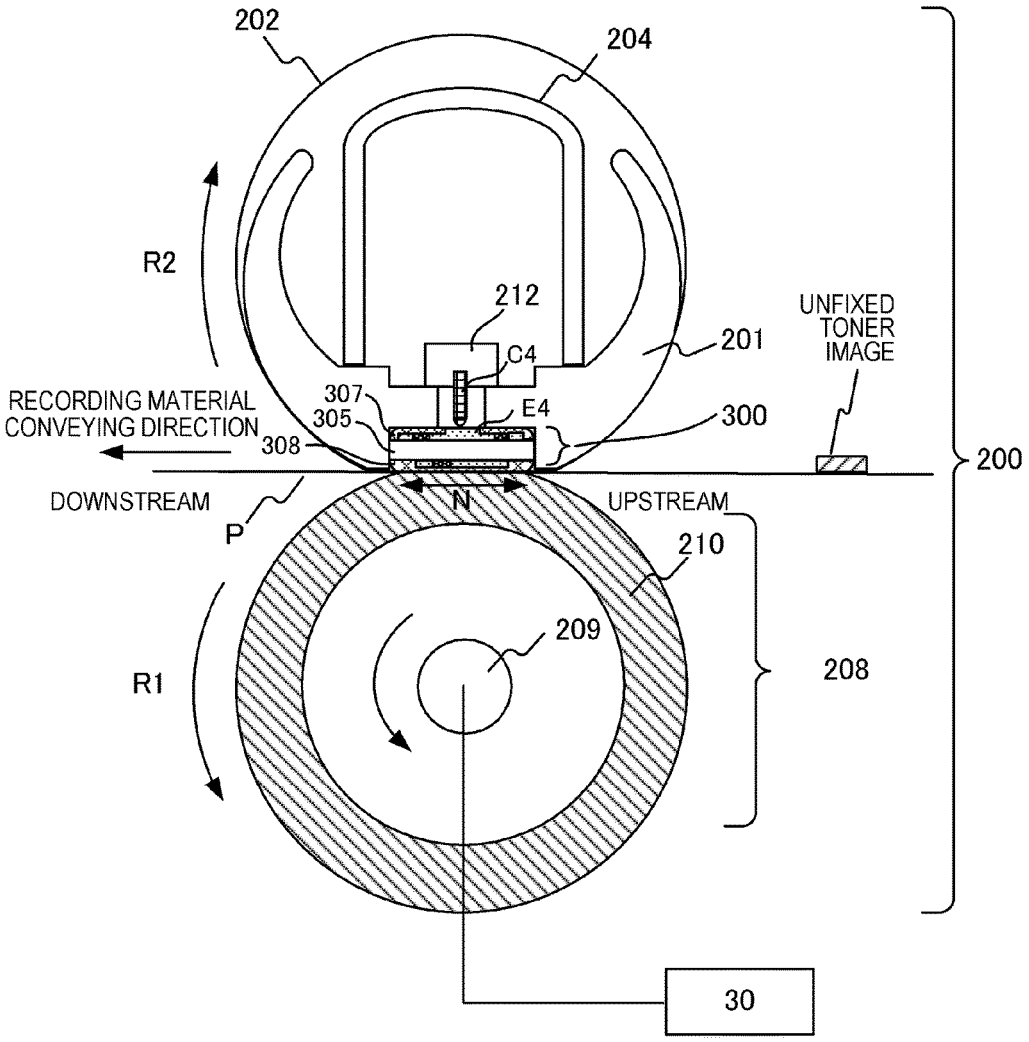
FIG. 2 is a sectional view of an image heating apparatus according to Example 1.

FIG. 2 is a schematic sectional view of the fixing apparatus 200 according to the present embodiment. The fixing apparatus 200 includes a fixing film 202, a heater 300 in contact with an inner surface of the fixing film 202, and a pressure roller 208 that forms a fixing nip portion N together with the heater 300 via the fixing film 202.

The fixing film 202 is a flexible heat-resistant multilayer film formed in a tubular shape, and a heat-resistant resin such as polyimide with a thickness of around 50 to 100 μm, or a metal such as stainless steel with a thickness of around 20 to 50 μm can be used as a base layer. In addition, a releasing layer for preventing toner adhesion and securing separability from the recording material P is formed on a surface of the fixing film 202. The releasing layer is a heat-resistant resin with superior releasability, such as a tetrafluoroethylene-perfluoro (alkyl vinyl ether) copolymer (PFA) with a thickness of around 10 to 50 μm. Furthermore, with a fixing film used in an apparatus that forms color images, in order to improve image quality, a heat-resistant rubber, such as silicone rubber, with a thickness of around 100 to 400 μm and thermal conductivity of around 0.2 to 3.0 W/m·K may be provided as an elastic layer between the base layer and the releasing layer. In the present embodiment, from the perspectives of thermal responsiveness, image quality, durability, and the like, polyimide with a thickness of 60 μm is used as the base layer, silicone rubber with a thickness of 300 μm and thermal conductivity of 1.6 W/m·K is used as the elastic layer, and PFA with a thickness of 30 μm is used as the releasing layer.

The pressure roller 208 includes a metal core 209 made of a material such as iron or aluminum, and an elastic layer 210 made of a material such as silicone rubber. The heater 300 is held by a heater holding member 201 made of a heat-resistant resin, and the heater 300 heats the fixing film 202. The heater holding member 201 also has a guiding function for guiding rotation of the fixing film 202. A metal stay 204 receives pressurizing force from a biasing member or the like (not shown) and biases the heater holding member 201 toward the pressure roller 208. The pressure roller 208 rotates in a direction of an arrow R1 due to power received from a motor 30. The rotation of the pressure roller 208 is followed by a rotation of the fixing film 202 in a direction of an arrow R2. The unfixed toner image on the recording material P is fixed by applying heat of the fixing film 202 while sandwiching and conveying the recording material P at the fixing nip portion N.

In the heater 300, a heat generating resistor as a heat generating element (a heat generating block to be described later) provided on a ceramic substrate 305 generates heat when energized. The heater 300 includes a surface protective layer 308 that comes into contact with an inner surface of the fixing film 202, and a surface protective layer 307 provided on an opposite side (hereinafter, referred to as a rear surface side) to the side of the substrate 305 on which the surface protective layer 308 is provided (hereinafter, referred to as a sliding surface side). Power supplying electrodes (an electrode E4 is shown as a representative) are provided on the rear surface side of the heater 300. Reference character C4 denotes an electrical contact in contact with the electrode E4, whereby power is supplied from the electrical contact C4 to the electrode E4. Details of the heater 300 will be provided later. In addition, a safety element 212 that is a thermo-switch, a temperature fuse, or the like, and that is actuated by abnormal heat generation of the heater 300 to interrupt power supplied to the heater 300 is arranged so as to oppose the rear surface side of the heater 300.

3. Configuration of Heater

Figure 3A:
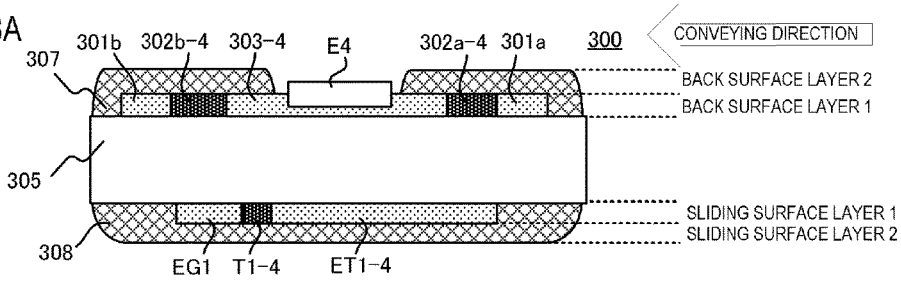
FIGS. 3A to 3C are views showing a heater configuration according to Example 1.
Figure 3B:
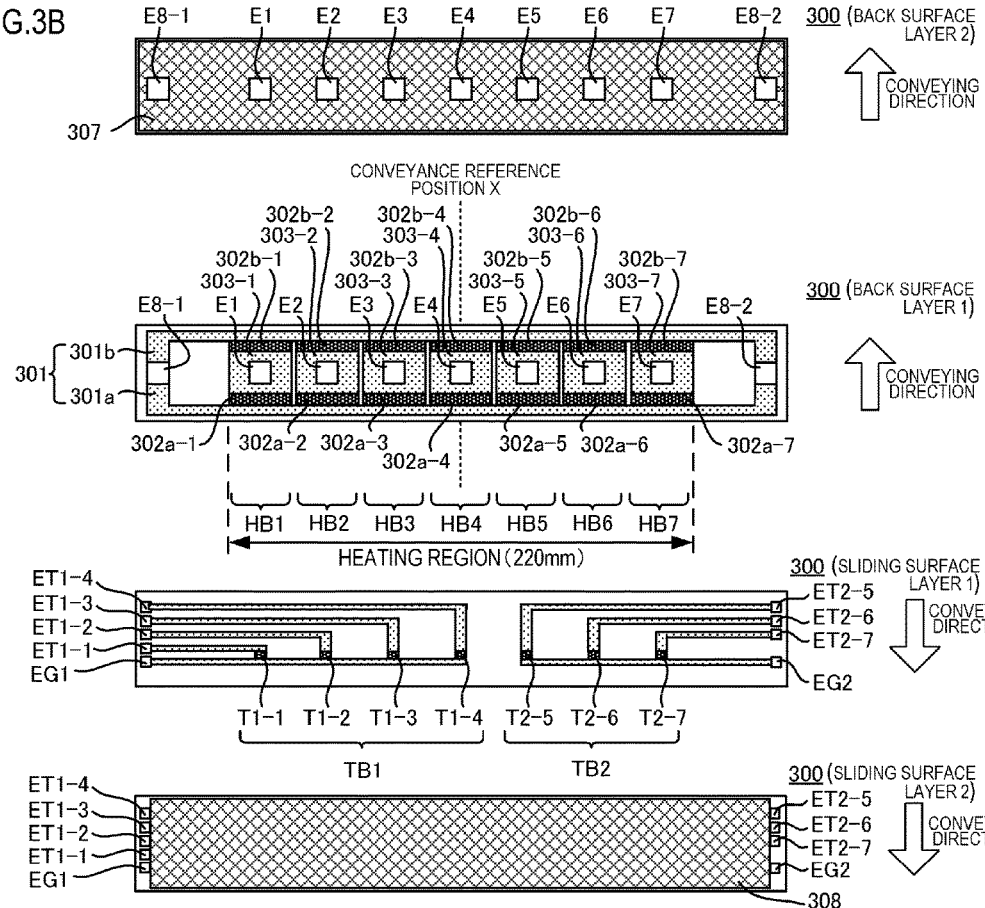
Figure 3C:
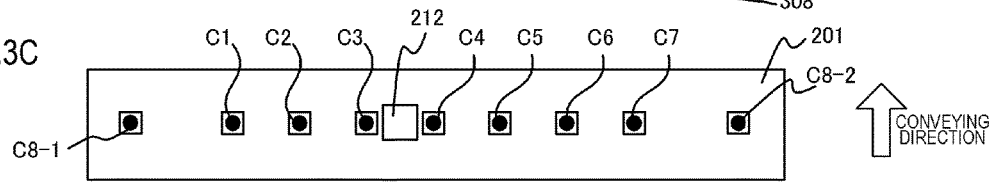

FIGS. 3A to 3C are schematic views showing a configuration of the heater 300 according to Example 1 of the present invention.

FIG. 3A is a sectional view of a heater in a vicinity of a conveyance reference position X shown in FIG. 3B. The conveyance reference position X is defined as a reference position when conveying the recording material P. In the image forming apparatus 100 according to the present example, the recording material P is conveyed so that a central section of the recording material P in a width direction orthogonal to the conveying direction passes the conveyance reference position X. The heater 300 generally has a five-layer structure in which two layers (rear surface layers 1 and 2) are formed on one surface (the rear surface) of the substrate 305 and two layers (sliding surface layers 1 and 2) are also formed on the other surface (the sliding surface) of the substrate 305.

The heater 300 has a first conductor 301 (301*a* and 301*b*) provided in a longitudinal direction of the heater 300 on a rear surface layer-side surface of the substrate 305. In addition, the heater 300 has a second conductor 303 (303-4 in the vicinity of the conveyance reference position X) provided in the longitudinal direction of the heater 300 at a position in a transverse direction (a direction orthogonal to the longitudinal direction) of the heater 300 that differs from the position of the first conductor 301 on the substrate 305. The first conductor 301 is separated into a conductor 301*a* arranged on an upstream side in the conveying direction of the recording material P, and a conductor 301*b* arranged on a downstream side in the conveying direction of the recording material P. Furthermore, the heater 300 has a heat generating resistor 302 that is provided between the first conductor 301 and the second conductor 303, and that generates heat due to power supplied via the first conductor 301 and the second conductor 303.

In the present example, the heat generating resistor 302 is separated into a heat generating resistor 302*a* (302*a*-4 in the vicinity of the conveyance reference position X) arranged on the upstream side in the conveying direction of the recording material P, and a heat generating resistor 302*b* (302*b*-4 in the vicinity of the conveyance reference position X) arranged on the downstream side in the conveying direction of the recording material P. In addition, the insulating (in the present example, glass) surface protective layer 307 that covers the heat generating resistor 302, the first conductor 301, and the second conductor 303 is provided on the rear surface layer 2 of the heater 300 so as to avoid the electrode portion (E4 in the vicinity of the conveyance reference position X).

FIG. 3B shows plan views of the respective layers of the heater 300. A heat generating block made of a set constituted by the first conductor 301, the second conductor 303, and the heat generating resistor 302, is provided in plurality in the longitudinal direction of the heater 300 on the rear surface layer 1 of the heater 300. The heater 300 according to the present embodiment has a total of seven heat generating blocks HB1 to HB7 in the longitudinal direction of the heater 300. A heating region ranges from a left end of the heat generating block HB1 in the diagram to a right end of the heat generating block HB7 in the diagram, and a length of the heating region is 220 mm. In the present embodiment, a width in the longitudinal direction of each heat generating block is the same. Widths in the longitudinal direction, however, need not necessarily be the same.

The heat generating blocks HB1 to HB7 are respectively constituted by heat generating resistors 302*a*-1 to 302*a*-7 and heat generating resistors 302*b*-1 to 302*b*-7 symmetrically formed in a transverse direction of the heater 300. The first conductor 301 is constituted by a conductor 301*a* that connects to the heat generating resistors (302*a*-1 to 302*a*-7) and a conductor 301*b* that connects to the heat generating resistors (302*b*-1 to 302*b*-7). In a similar manner, the second conductor 303 is divided into seven conductors 303-1 to 303-7, so as to correspond to the seven heat generating blocks HB1 to HB7.

Electrodes E1 to E7, E8-1, and E8-2 are connected to electrical contacts C1 to C7, C8-1, and C8-2. The electrodes E1 to E7 are, respectively, electrodes for supplying power to the heat generating blocks HB1 to HB7 via the conductors 303-1 to 303-7. The electrodes E8-1 and E8-2 are common electrodes for supplying power to the seven heat generating blocks HB1 to HB7 via the conductor 301*a* and the conductor 301*b*. While the electrodes E8-1 and E8-2 are provided at both ends in the longitudinal direction in the present example, for example, a configuration in which only the electrode E8-1 is provided on one side (in other words, a configuration in which the electrode E8-2 is not provided) may be adopted, or each of the electrodes E8-1 and E8-2 may be divided in two in the conveying direction of the recording material.

The surface protective layer 307 of the rear surface layer 2 of the heater 300 is formed so as to expose the electrodes E1 to E7, E8-1, and E8-2. Accordingly, a configuration is realized in which the electrical contacts C1 to C7, C8-1, and C8-2 can be connected to the respective electrodes from the rear surface layer-side of the heater 300 and power can be supplied from the rear surface layer-side. In addition, a configuration is realized in which power supplied to at least one heat generating block among the heat generating blocks HB1 to HB7, and power supplied to another of the heat generating blocks HB1 to HB7 can be controlled independently.

Since providing the electrodes on the rear surface of the heater 300 dispenses with the need to perform wiring with a conductive pattern on the substrate 305, a width of the substrate 305 in the transverse direction can be reduced. Therefore, effects of reducing a material cost of the substrate 305 and reducing a startup time required to increase the temperature of the heater 300 due to reduced heat capacity of the substrate 305 can be produced. Moreover, the electrodes E1 to E7 are provided in a region in which heat generating resistors are provided in a longitudinal direction of the substrate.

In the present embodiment, a material having characteristics in which a resistance value increases as temperature rises (hereinafter, referred to as PTC characteristics) is used as the heat generating resistor 302. Using a material having PTC characteristics as a heat generating resistor produces an effect where, during a fixing process of a sheet of small-sized paper, a resistance value of a heat generating resistor in a non-paper-passing section becomes higher than a resistance value of a heat generating resistor in a paper-passing section, and inhibits the flow of current through the heat generating resistor in the non-paper-passing section. As a result, an effect of suppressing a temperature rise of the non-paper-passing section can be increased. The material used in the heat generating resistor 302 is not, however, limited to a material having PTC characteristics, and a material having characteristics in which a resistance value decreases as temperature rises (hereinafter, referred to as NTC characteristics), or a material having characteristics in which a resistance value remains unchanged with respect to a change in temperature can also be used.

Thermistors T1-1 to T1-4 and thermistors T2-5 to T2-7 are provided on the sliding surface layer 1 on the side of the sliding surface (a surface on the side in contact with the fixing film) of the heater 300 in order to detect a temperature of each of the heat generating blocks HB1 to HB7 of the heater 300. The thermistors T1-1 to T1-4 and the thermistors T2-5 to T2-7 are made by thinly forming, on a substrate, a material that has a PTC property or an NTC property (in the present embodiment, an NTC property). Since thermistors are provided for all of the heat generating blocks HB1 to HB7, the temperature of all heat generating blocks can be detected by detecting resistance values of the thermistors.

In order to energize the four thermistors T1-1 to T1-4, conductors ET1-1 to ET1-4 for detecting resistance values of the thermistors and a common conductor EG1 of the thermistors are formed. A set constituted by the conductors EG1 an ET1-1 to ET1-4 and the thermistors T1-1 to T1-4 form a thermistor block TB1. In a similar manner, in order to energize the three thermistors T2-5 to T2-7, conductors ET2-5 to ET2-7 for detecting resistance values of the thermistors and a common conductor EG2 of the thermistors are formed. A set constituted by the conductors EG2 and ET2-5 to ET2-7 and the thermistors T2-5 to T2-7 form a thermistor block TB2.

Effects produced by the use of the thermistor block TB1 will be described. First, by forming the common conductor EG1 of the thermistors, the cost of forming wiring with a conductive pattern can be reduced as compared to a case in which wiring is performed by respectively connecting conductors to the thermistors T1-1 to T1-4. In addition, since there is no need to perform wiring with a conductive pattern on the substrate 305, a width of the substrate 305 in the transverse direction can be reduced. Therefore, effects of reducing a material cost of the substrate 305 and reducing a startup time required to increase the temperature of the heater 300 due to reduced heat capacity of the substrate 305 can be produced. Effects produced by the use of the thermistor block TB2 are similar to those produced by the thermistor block TB1, and a description thereof will be omitted.

An effective method of reducing the width of the substrate 305 in the transverse direction involves using a combination of the configuration of the heat generating blocks HB1 to HB7 described with reference to the rear surface layer 1 in FIG. 3A, and the thermistor blocks TB1 and TB2 described with reference to the sliding surface layer 1 in FIG. 3A.

The slidable surface protective layer 308 (glass in the present example) is provided on the sliding surface layer 2 on the side of the sliding surface (the surface in contact with the fixing film) of the heater 300. The surface protective layer 308 is formed avoiding both ends of the heater 300 in order to allow electrical contacts to be connected to the conductors ET1-1 to ET1-4 and ET2-5 to ET2-7 for detecting resistance values of the thermistors and to the common conductors EG1 and EG2 of the thermistors. The surface protective layer 308 is at least provided in a region that slides against the film 202 excluding both ends of a surface of the heater 300 opposing the film 202.

As shown in FIG. 3C, a surface opposing the heater 300 of the heater holding member 201 is provided with holes for connecting the electrodes E1, E2, E3, E4, E5, E6, E7, E8-1, and E8-2 with the electrical contacts C1 to C7, C8-1, and C8-2, respectively. The safety element 212 described earlier and the electrical contacts C1 to C7, C8-1, and C8-2 are provided between the stay 204 and the heater holding member 201. The electrical contacts C1 to C7, C8-1, and C8-2 that are in contact with the electrodes E1 to E7, E8-1, and E8-2 are respectively electrically connected to an electrode section of the heater 300 by a method such as biasing by a spring or welding. Each electrical contact C1 to C7, C8-1, and C8-2 is connected to the control circuit 400 (to be described later) of the heater 300 via a cable or a conductive material such as a thin metal plate provided between the stay 204 and the heater holding member 201. In addition, the electrical contacts provided on the conductors ET1-1 to ET1-4 and ET2-5 to ET2-7 for detecting resistance values of the thermistors and the common conductors EG1 and EG2 of the thermistors are also connected to the control circuit 400 to be described later.

4. Configuration of Heater Control Circuit

Figure 4:
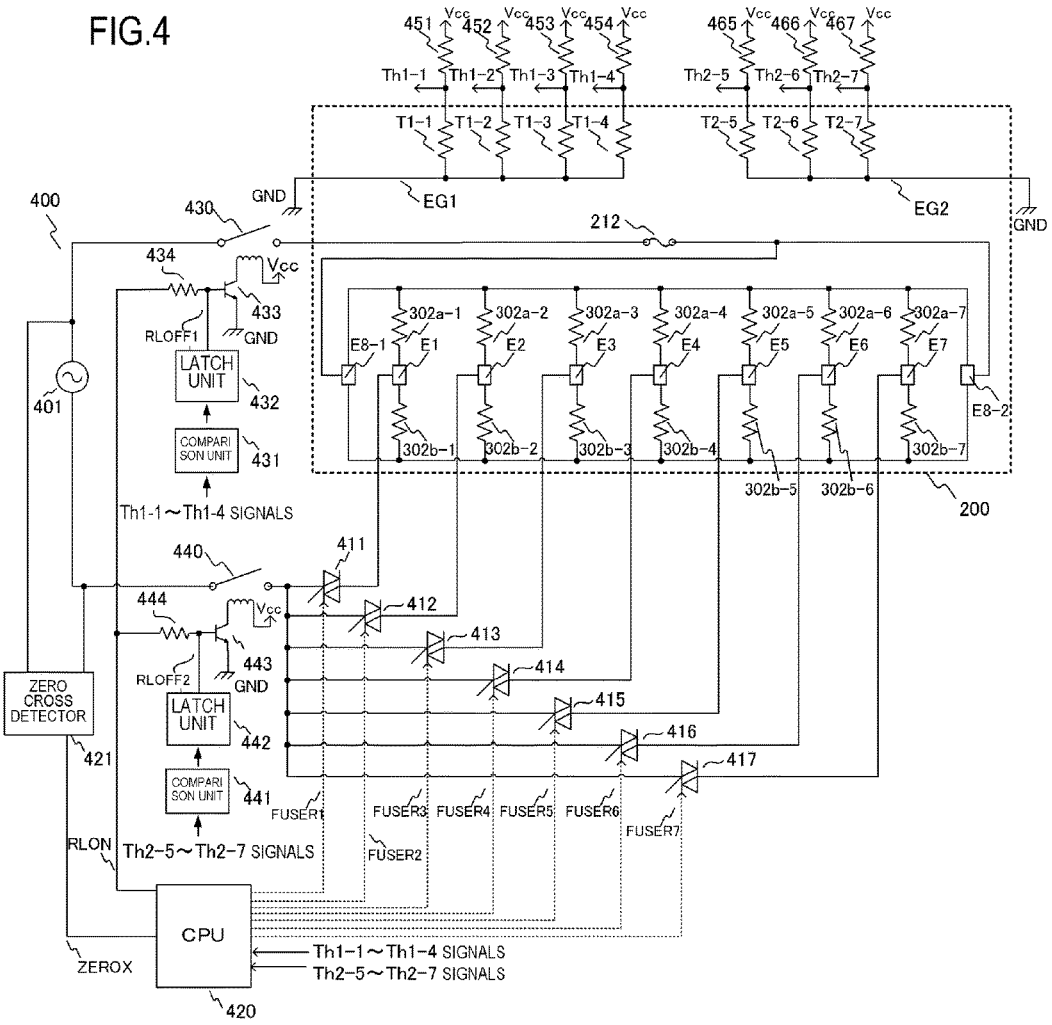
FIG. 4 is a heater control circuit diagram according to Example 1.

FIG. 4 is a circuit diagram of the control circuit 400 of the heater 300 according to Example 1. Reference numeral 401 denotes a commercial AC power supply connected to the image forming apparatus 100. Power control of the heater 300 is performed by energizing/interrupting energization of triacs 411 to 417. The triacs 411 to 417 respectively operate in accordance with signals FUSER1 to FUSER7 from a CPU 420. Driving circuits of the triacs 411 to 417 are shown in an abbreviated form. The control circuit 400 of the heater 300 has a circuit configuration that enables the seven heat generating blocks HB1 to HB7 to be independently controlled with the seven triacs 411 to 417. A zero-cross detector 421 is a circuit that detects a zero cross of the AC power supply 401 and that outputs a ZEROX signal to the CPU 420. The ZEROX signal is used for detecting timings of phase control and wave number control of the triacs 411 to 417 and the like.

A method of detecting the temperature of the heater 300 will now be described. For the temperature detected by the thermistors T1-1 to T1-4 of the thermistor block TB1, a divided voltage of the thermistors T1-1 to T1-4 and resistors 451 to 454 is detected as a signal Th1-1 to Th1-4 by the CPU 420. In a similar manner, for the temperature detected by the thermistors T2-5 to T2-7 of the thermistor block TB2, a divided voltage of the thermistors T2-5 to T2-7 and resistors 465 to 467 is detected as a signal Th2-5 to Th2-7 by the CPU 420. During internal processing by the CPU 420, power to be supplied is calculated based on a difference between a control target temperature of each heat generating block HB1 to HB7 and a detected current temperature of a thermistor. For example, the power to be supplied is calculated by PI control. Furthermore, a conversion is made to a control level of a phase angle (phase control) or a wave number (wave number control) corresponding to the supplied power, and the triacs 411 to 417 are controlled based on control conditions thereof.

A relay 430 and a relay 440 are used as means that interrupt power to the heater 300 when the temperature of the heater 300 rises excessively due to a failure or the like. Circuit operations of the relay 430 and the relay 440 will now be described. When a RLON signal assumes a High state, a transistor 433 is switched to an ON state, a secondary-side coil of the relay 430 is energized by a power supply voltage Vcc, and a primary-side contact of the relay 430 is switched to an ON state. When the RLON signal assumes a Low state, the transistor 433 is switched to an OFF state, a current flowing from the power supply voltage Vcc to the secondary-side coil of the relay 430 is interrupted, and the primary-side contact of the relay 430 is switched to an OFF state. In a similar manner, when the RLON signal assumes a High state, a transistor 443 is switched to an ON state, a secondary-side coil of the relay 440 is energized by the power supply voltage Vcc, and a primary-side contact of the relay 440 is switched to an ON state. When the RLON signal assumes a Low state, the transistor 443 is switched to an OFF state, a current flowing from the power supply voltage Vcc to the secondary-side coil of the relay 440 is interrupted, and the primary-side contact of the relay 440 is switched to an OFF state.

Operations of a safety circuit using the relay 430 and the relay 440 will now be described. When any one of the detected temperatures of the thermistors Th1-1 to Th1-4 exceeds a respectively set predetermined value, a comparison unit 431 operates a latch unit 432, and the latch unit 432 latches an RLOFF1 signal in a Low state. When the RLOFF1 signal assumes a Low state, since the transistor 433 is kept in an OFF state even when the CPU 420 changes the RLON signal to a High state, the relay 430 can be kept in an OFF state (a safe state). Moreover, in a non-latched state, the latch unit 432 sets the RLOFF1 signal to open-state output. In a similar manner, when any one of the detected temperatures of the thermistors Th2-5 to Th2-7 exceeds a respectively set predetermined value, a comparison unit 441 operates a latch unit 442, and the latch unit 442 latches an RLOFF2 signal in a Low state. When the RLOFF2 signal assumes a Low state, since the transistor 443 is kept in an OFF state even when the CPU 420 changes the RLON signal to a High state, the relay 440 can be kept in an OFF state (a safe state). In a similar manner, in a non-latched state, the latch unit 442 sets the RLOFF2 signal to open-state output.

5. Heater Control Method

Figure 5:
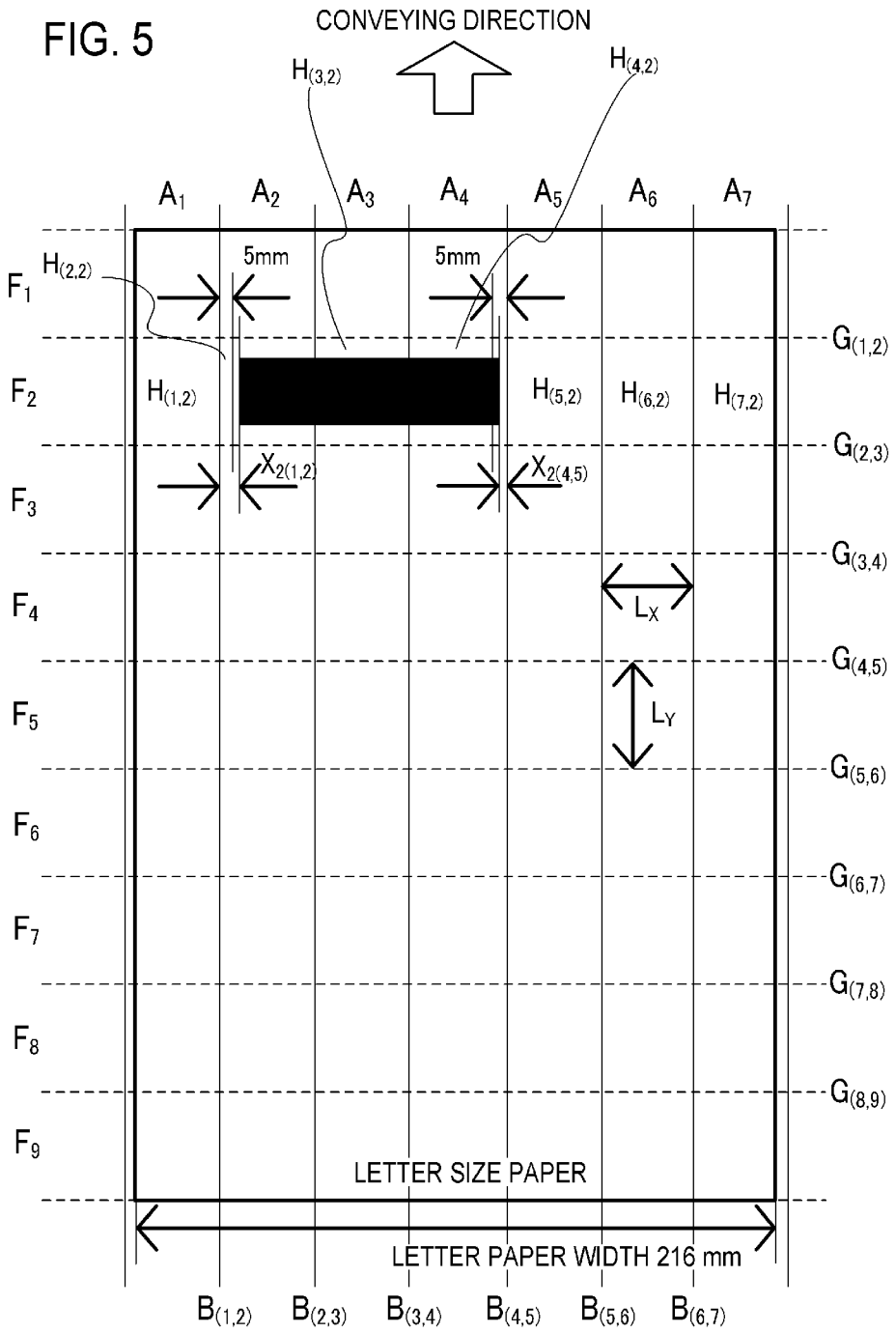
FIG. 5 is an explanatory diagram of a heating region of a heater according to Example 1.

A heater control method according to the present embodiment will be described with reference to FIG. 5. In the image forming apparatus 100 according to the present embodiment, power supply to the seven heat generating blocks HB1 to HB7 of the heater 300 is controlled in accordance with image data transmitted from an external apparatus (not shown) such as a host computer. FIG. 5 is a schematic diagram for describing a heater control method according to the present embodiment when an image formation region of a recording material P with a size of a LETTER size paper is divided into seven heating regions $A_1$ to $A_7$ in the longitudinal direction. An image formation surface of the recording material P can be divided into a matrix, shown in FIG. 5, based on a size of the heat generating blocks HB1 to HB7. The CPU 420 performs control so that each region in the matrix is heated by the seven heat generating blocks HB1 to HB7. The image formation surface of the recording material P is divided (heating regions $A_1$ to $A_7$) in correspondence to a width of each of the heat generating blocks HB1 to HB7 in a transverse direction (a direction orthogonal to the conveying direction of the recording material P (a width direction of the recording material P)). In addition, the image formation surface of the recording material P is divided (heating regions $F_1$ to $F_9$) in accordance with a control period of each of the heat generating blocks HB1 to HB7 in a longitudinal direction (the conveying direction of the recording material P).

The heating regions $A_1$ to $A_7$ correspond to the heat generating blocks HB1 to HB7 and are configured such that, for example, the heating region $A_1$ is heated by the heat generating block HB1 and the heating region $A_7$ is heated by the heat generating block HB7. In addition, a total length of the heating regions $A_1$ to $A_7$ is 220 mm, and each of the regions is an equal 7-way division thereof ($L_X$=31.4 mm). The respective heating regions are partitioned by six boundary positions $B_{(1,2)}$ to $B_{(6,7)}$. In addition, the seven heating regions $A_1$ to $A_7$ are divided into the nine heating regions $F_1$ to $F_9$ in the conveying direction of the recording material P, and the nine heating regions $F_1$ to $F_9$ are respectively partitioned by eight boundary positions $G_{(1,\ 2)}$ to $G_{(8,\ 9)}$. Furthermore, a total length of the heating regions $F_1$ to $F_9$ is 279.4 mm (the length of a sheet of LETTER size paper in the conveying direction), and each of the regions is an equal 9-way division thereof ($L_Y$=31.04 mm).

In Example 1, a rectangular heating section $H_{(i,j)}$ with an area of $L_X \times L_Y$ and constituted by a combination of a heating region $A_i$(i=1 to 7) and a heating region $F_j$(j=1 to 9) is considered a unit region of heat generating quantity control. When an image exists in the heating section $H_{(i,\ j)}$, the heating section $H_{(i,\ j)}$ is referred to as an "image heating section PR". Moreover, the image heating section PR may also be referred to as a first heating region. On the other hand, when an image does not exist in the heating section $H_{(i,j)}$, the heating section $H_{(i,j)}$ is referred to as a "non-image heating section PP". Moreover, the non-image heating section PP may also be referred to as a second heating region.

Each heating section $H_{(i,\ j)}$ is heated by a corresponding heat generating block (a heat generating element). Each heat generating block is controlled to as to maintain a control temperature $T_{(i,j)}$. First, a heat generating block to heat the image heating section PR is controlled to as to maintain the control temperature $T_{(i,j)}$=TR. In other words, when the heating section $H_{(i,j)}$ is the image heating section PR, the image heating section PR is heated at a reference control temperature $T_{(i,j)}$=TR (for example, TR=230° C.) with the exception of cases in which both a condition $M_1$ and a condition $M_2$ (to be described later) are satisfied. On the other hand, a heat generating block corresponding to the heating section $H_{(i,j)}$ that is the non-image heating section PP is controlled to as to maintain the control temperature $T_{(i,j)}$=TP. In other words, when the heating section $H_{(i,j)}$ is the non-image heating section PP, the non-image heating section PP is heated at the control temperature $T_{(i,j)}$=TP. The control temperature TP is a lower temperature (for example, TP=120° C.) than the control temperature TR.

When the non-image heating section PP is adjacent to at least one image heating section PR in the longitudinal direction of the heater 300, a temperature gradient due to a difference between control temperatures may occur in a vicinity of a boundary position of the image heating section PR and the non-image heating region PP. As a result, there is a possibility that fixing failure may occur in an image on the recording material P corresponding to the vicinity of the boundary position (for example, a region of less than 5 mm from the boundary position) in the image heating section PR.

In consideration thereof, in the present embodiment, when both the condition $M_1$ and the condition $M_2$ described below are satisfied, the control temperature of the heating section $H_{(i,j)}$ is increased by a predetermined amount ΔT (for example, ΔT=10° C.) as compared to a case in which at least one of the condition $M_1$ and the condition $M_2$ is not satisfied.

(Condition $M_1$) The heating section $H_{(i,j)}$ is the image heating section PR and at least one of a heating section $H_{(i-1,j)}$ and a heating section $H_{(i+1,j)}$ adjacent thereto in the longitudinal direction of the heater is the non-image heating section PP.

(Condition $M_2$) A distance in the longitudinal direction of the heater between a boundary position of the image heating section PR and the non-image heating section PP and an end section in the longitudinal direction of an image formed in the image heating section PR on the side of the non-image heating section PP is less than a predetermined distance (in the present example, less than 5 mm).

In the present embodiment, TP=120° C., TR=230° C., and ΔT=10° C. are adopted. Using these parameters prevents an occurrence of fixing failure of an image in $H_{(i,j)}$ when both the condition $M_1$ and the condition $M_2$ described above are satisfied.

Figure 6:
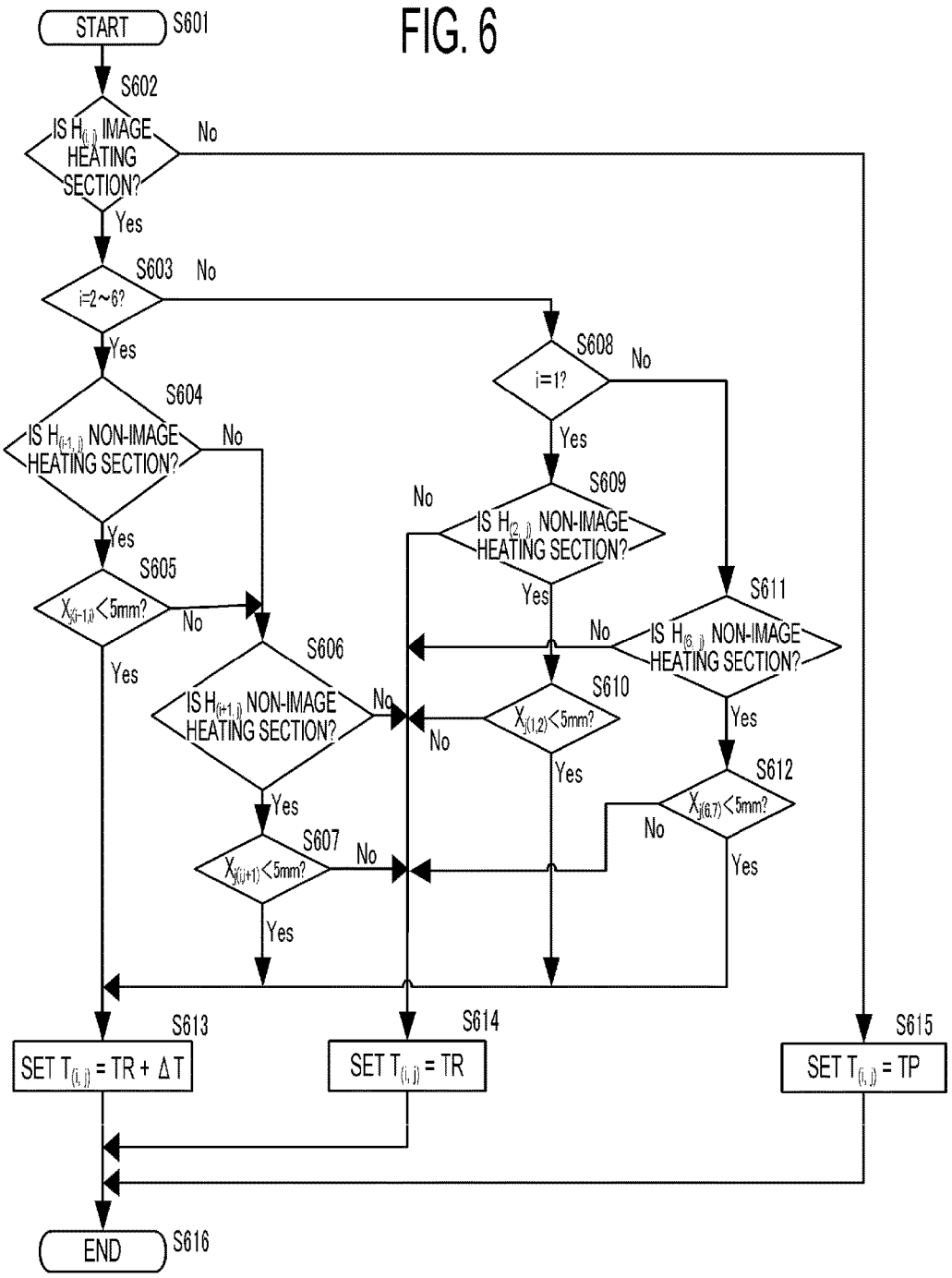
FIG. 6 is flow chart showing a determination flow of a control temperature of a heating region according to Example 1.

FIG. 6 shows a determination flow of a control temperature $T_{(i,j)}$ of the heating section $H_{(i,j)}$ according to Example 1. When the determination flow is started in S601, in S602, a determination is made on whether or not the heating section $H_{(i,j)}$ is the image heating section PR. When the heating section $H_{(i,j)}$ is the image heating section PR, the determination flow proceeds to S603. When the heating section $H_{(i,j)}$ is the non-image heating section PP instead of the image heating section PR, the determination flow proceeds to S615, sets the control temperature $T_{(i,j)}$ of the heating section $H_{(i,j)}$ to TP, and proceeds to S616.

In S603, a determination is made on whether or not a number i of the heating section $H_{(i,j)}$, the control temperature of which is currently being determined, is any of 2 to 6. When i is any of 2 to 6, the determination flow proceeds to S604. When i is not any of 2 to 6 and is 1 or 7, the determination flow proceeds to S608.

In S604, a determination is made on whether or not the heating section $H_{(i-1,j)}$ adjacent to the heating section $H_{(i,j)}$ is the non-image heating section PP. The determination flow proceeds to S605 when it is determined that the heating section $H_{(i-1,j)}$ is the non-image heating section PP. On the other hand, the determination flow proceeds to S606 when it is determined that the heating section $H_{(i-1,j)}$ is the image heating section PR instead of the non-image heating section PP.

In S605, a determination is made on whether or not a distance $X_{j(i-1,j)}$ in the longitudinal direction between an end section of an image formed in the heating section $H_{(i,j)}$ on the side of the heating section $H_{(i-1,j)}$ and a boundary position $B_{(i-1,i)}$ is less than 5 mm. When it is determined that the distance $X_{j(i-1,i)}$ is less than 5 mm, the determination flow proceeds to S613 to determine TR+ΔT as the control temperature $T_{(i,j)}$ of the heating section $H_{(i,j)}$ and subsequently proceeds to S616. On the other hand, when it is determined that the distance $X_{j(i-1,i)}$ is equal to or greater than a predetermined distance or, in other words, not less than 5 mm, the determination flow proceeds to S606.

In S606, a determination is made on whether or not the heating section $H_{(i+1,j)}$ adjacent to the heating section $H_{(i,j)}$ is the non-image heating section PP. The determination flow proceeds to S607 when it is determined that the heating section $H_{(i+1,j)}$ is the non-image heating section PP. On the other hand, when it is determined that the heating section $H_{(i+1,j)}$ is the image heating section PR instead of the non-image heating section PP, the determination flow proceeds to S614, determines TR as the control temperature $T_{(i,j)}$ of the heating section $H_{(i,j)}$, and proceeds to S616.

In S607, a determination is made on whether or not a distance $X_{j(i,i+1)}$ in the longitudinal direction between an end section of an image formed in the heating section $H_{(i,j)}$ on the side of the heating section $H_{(i+1,j)}$ and a boundary position $B_{(i,i+1)}$ is less than 5 mm. When it is determined that the distance $X_{j(i,i+1)}$ is less than 5 mm, the determination flow proceeds to S613 to determine TR+ΔT as the control temperature $T_{(i,j)}$ of the heating section $H_{(i,j)}$ and subsequently proceeds to S616. On the other hand, when it is determined that the distance $X_{j(i,i+1)}$ is not less than 5 mm, the determination flow proceeds to S614 to determine TR as the control temperature $T_{(i,j)}$ of the heating section $H_{(i,j)}$ and subsequently proceeds to S616.

In S608, a determination is made on whether or not the number i of the heating section $H_{(i,j)}$, the control temperature of which is currently being determined is 1. When i is 1, the determination flow proceeds to S609. When i is not 1 but 7, the determination flow proceeds to S611.

In S609, a determination is made on whether or not a heating section $H_{(2,j)}$ adjacent to a heating section $H_{(1,j)}$ is the non-image heating section PP. The determination flow proceeds to S610 when it is determined that the heating section $H_{(2,j)}$ is the non-image heating section PP. On the other hand, when it is determined that the heating section $H_{(2,j)}$ is not the non-image heating section PP, the determination flow proceeds to S614, determines TR as the control temperature $T_{(i,j)}$ of the heating section $H_{(i,j)}$, and proceeds to S616.

In S610, a determination is made on whether or not a distance $X_{j(1,2)}$ in the longitudinal direction between an end section of an image formed in the heating section $H_{(1,j)}$ on the side of the heating section $H_{(2,j)}$ and the boundary position $B_{(1,2)}$ is less than 5 mm. When it is determined that the distance $X_{j(1,2)}$ is less than 5 mm, the determination flow proceeds to S613 to determine TR+ΔT as the control temperature $T_{(i,j)}$ of the heating section $H_{(i,j)}$ and subsequently proceeds to S616. On the other hand, when it is determined that the distance $X_{j(1,2)}$ is not less than 5 mm, the determination flow proceeds to S614 to determine TR as the control temperature $T_{(i,j)}$ of the heating section $H_{(i,j)}$, and subsequently proceeds to S616.

In S611, a determination is made on whether or not a heating section $H_{(6,j)}$ adjacent to a heating section $H_{(7,j)}$ is the non-image heating section PP. The determination flow proceeds to S612 when it is determined that the heating section $H_{(6,j)}$ is the non-image heating section PP. On the other hand, when it is determined that the heating section $H_{(6,j)}$ is not the non-image heating section PP, the determination flow proceeds to S614, determines TR as the control temperature $T_{(i,j)}$ of the heating section $H_{(i,j)}$, and proceeds to S616.

In S612, a determination is made on whether or not a distance $X_{j(6,7)}$ in the longitudinal direction between an end section of an image formed in the heating section $H_{(7,j)}$ on the side of the heating section $H_{(6,j)}$ and the boundary position $B_{(6,7)}$ is less than 5 mm. When it is determined that the distance $X_j$(6, 7) is less than 5 mm, the determination flow proceeds to S613 to determine TR+ΔT as the control temperature $T_{(i,j)}$ of the heating section $H_{(i,j)}$ and subsequently proceeds to S616. On the other hand, when it is determined that the distance $X_{j(6,7)}$ is not less than 5 mm, the determination flow proceeds to S614 to determine TR as the control temperature $T_{(i,j)}$ of the heating section $H_{(i,j)}$, and subsequently proceeds to S616. In S616, the determination flow of the control temperature $T_{(i,j)}$ of the heating section $H_{(i,j)}$ is ended.

Contents of heat generating quantity control according to the present embodiment will now be described in concrete terms with reference to FIGS. 5 and 7. FIG. 5 is a schematic diagram of the recording material P when a rectangular solid image is formed from a heating section $H_{(2,2)}$ to a heating section $H_{(4,2)}$, so that a toner amount on the recording material reaches 1.15 mg/cm$^2$ with the image forming apparatus 100 according to the present example. The heating sections $H_{(2,2)}$, $H_{(3,2)}$, and $H_{(4,2)}$ are image heating sections PR. In addition, heating sections other than those described above are all non-image heating sections PP.

In FIG. 5, the heating section $H_{(2,2)}$ that is the image heating section PR satisfies the condition $M_1$ since the image heating section $H_{(1,2)}$ adjacent thereto in the longitudinal direction of the heater is the non-image heating section PP. The distance $X_{2(1,2)}$ in the longitudinal direction of the heater between an end section of an image in the heating section $H_{(2,2)}$ on a side of the heating section $H_{(1,2)}$ and a boundary position $B_{(1,2)}$ is, however, equal to or more than 5 mm. In other words, the heating section $H_{(2,2)}$ that is the image heating section PR satisfies the condition $M_1$, but does not satisfy the condition $M_2$. On the other hand, the heating section $H_{(4,2)}$ that is the image heating section PR satisfies the condition $M_1$ since the image heating section $H_{(5,2)}$ adjacent thereto in the longitudinal direction of the heater is the non-image heating section PP. In addition, the distance $X_{2(4,5)}$ in the longitudinal direction of the heater between an end section of an image in the heating section $H_{(4,2)}$ on a side of the heating section $H_{(5,2)}$ and the boundary position $B_{(4,5)}$ is less than 5 mm. In other words, the heating section $H_{(4,2)}$ that is the image heating section PR satisfies both the condition $M_1$ and the condition $M_2$.

Control temperature determination methods according to Example 1, Comparative Example 1, and Comparative Example 2 will now be described. First, in Example 1, a control temperature is determined using the determination flow of the control temperature $T_{(i,j)}$ of the heating section $H_{(i,j)}$ shown in FIG. 6. In addition, Comparative Example 1 represents a case in which the control temperature $T_{(i,j)}$ is determined by referring to Japanese Patent Application Laid-open No. H6-95540. In Comparative Example 1, the control temperature $T_{(i,j)}$ is uniformly set to TR when the heating section $H_{(i,j)}$ is the image heating section PR. In addition, Comparative Example 2 represents a case in which the control temperature $T_{(i,j)}$ is determined by referring to Japanese Patent Application Laid-open No. 2015-52722. In Comparative Example 2, a control temperature of the non-image heating section PP adjacent to the heating section $H_{(i,j)}$ is set to TR when the heating section $H_{(i,j)}$ satisfies both the condition $M_1$ and the condition $M_2$ described above.

Figure 7A:
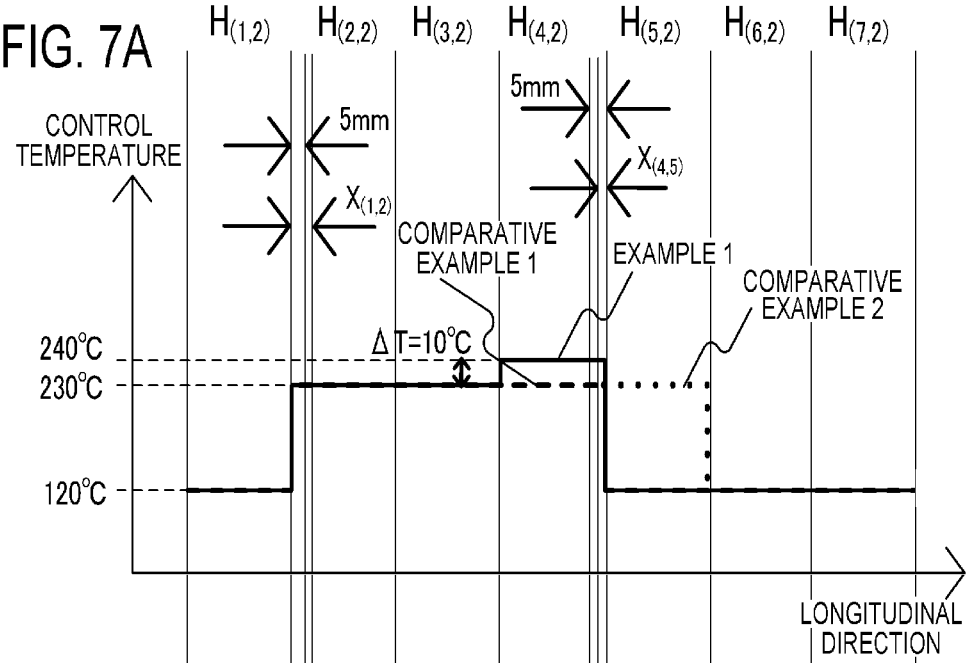
FIGS. 7A and 7B are diagrams showing a distribution in a longitudinal direction of a control temperature of a heating section and a surface temperature of a fixing film.

FIG. 7A shows a distribution in the longitudinal direction of control temperatures in a heating region $F_2$. A solid line represents Example 1. In Example 1, control temperatures of heat generating blocks corresponding to the heating sections $H_{(2,2)}$, $H_{(3,2)}$, and $H_{(4,2)}$ as image heating sections PR are, respectively, 230° C., 230° C., and 240° C. In addition, control temperatures of heat generating blocks corresponding to the heating sections $H_{(1,2)}$, $H_{(5,2)}$, $H_{(6,2)}$, and $H_{(7,2)}$ as non-image heating sections PP are uniformly 120° C. Since the heating section $H_{(4,2)}$ satisfies both the condition $M_1$ and the condition $M_2$ described earlier, the control temperature is set to a temperature higher than those of other image heating sections by a predetermined amount ΔT=10° C.

As described above, the heater 300 according to the present embodiment is structured so as to include a first heat generating element (heat generating block) and a second heat generating element (heat generating block) that are adjacent to each other in the longitudinal direction of the heater. In addition, when an image exists in a second region on the recording material heated by the second heat generating element, and an image does not exist in a first region on the recording material heated by the first heat generating element, the control portion sets the control temperature of the second heat generating element when heating the second region based on a distance between an end section of the image in the second region and a boundary of the first region and the second region.

A dashed line in FIG. 7A represents Comparative Example 1, in which control temperatures of heat generating blocks corresponding to the heating sections $H_{(2,2)}$, $H_{(3,2)}$, and $H_{(4,2)}$ as image heating sections PR are uniformly 230° C. In addition, control temperatures of heat generating blocks corresponding to the heating sections $H_{(1,2)}$, $H_{(5,2)}$, $H_{(6,2)}$, and $H_{(7,2)}$ as non-image heating sections PP are uniformly 120° C. A dotted line in FIG. 7A represents Comparative Example 2, in which control temperatures of heat generating blocks corresponding to the heating sections $H_{(2,2)}$, $H_{(3,2)}$, and $H_{(4,2)}$ as image heating sections PR are uniformly 230° C. In addition, the control temperature of the heat generating block corresponding to the heating section $H_{(5,2)}$ as the non-image heating section PP is set to 230° C. that is the same as the image heating sections, and the control temperatures of heat generating blocks corresponding to the heating sections $H_{(1,2)}$, $H_{(6,2)}$, and $H_{(7,2)}$ as other non-image heating sections PP are respectively 120° C. Furthermore, although not shown, heating regions other than the heating region $F_2$ are entirely constituted by non-image heating sections and control temperatures thereof are uniformly 120° C. in all of Example 1, Comparative Example 1, and Comparative Example 2.

Figure 7B:
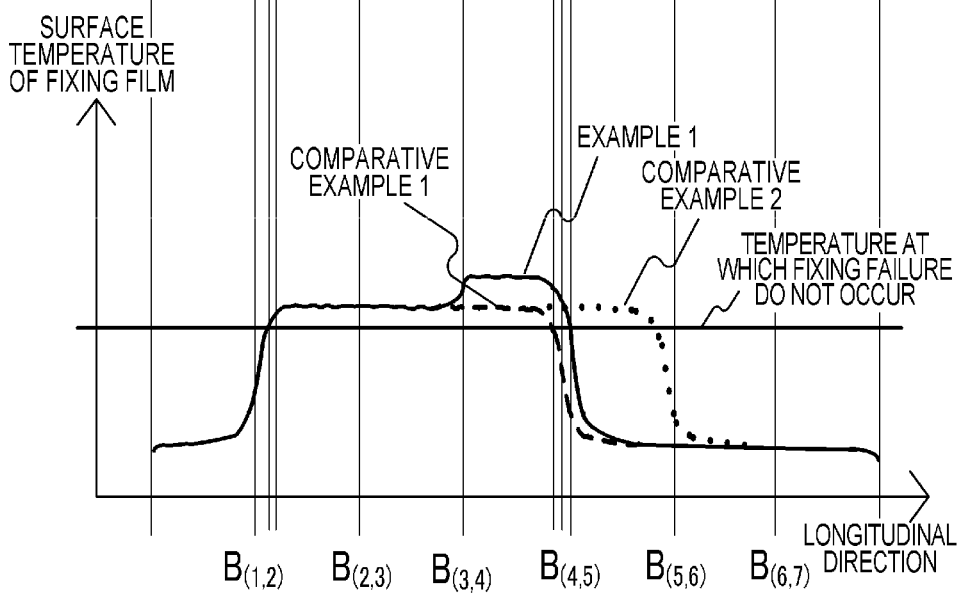

FIG. 7B shows a distribution in the longitudinal direction of surface temperatures of the fixing film 202 in the respective heating sections in the heating region $F_2$. A solid line represents a surface temperature of the fixing film 202 when each heating region of the recording material P is heated at the control temperature according to Example 1. A dashed line represents a surface temperature of the fixing film 202 according to Comparative Example 1, and a dotted line represents a surface temperature of the fixing film 202 according to Comparative Example 2. In a vicinity of a boundary position of the image heating section and the non-image heating section shown in FIG. 7B, a temperature gradient is created between both heating sections. As a result, the surface temperature of the fixing film 202 in the image heating section in the vicinity of the boundary position with the non-image heating section becomes lower than the temperature of the fixing film 202 inside the image heating section.

In the case of Comparative Example 1, due to the phenomenon described earlier, the surface temperature of the fixing film 202 becomes lower than a temperature at which fixing failures do not occur in a region of less-than-5 mm end sections on a side of the boundary position $B_{(1, 2)}$ of the heating section $H_{(2, 2)}$ and on a side of $B_{(4, 5)}$ of the image heating section $PR_{(4, 2)}$. Since an image exists in a less-than-5 mm end section on a side of $B_{(4, 5)}$ of the heating region $PR_{(4, 2)}$, there is a possibility that a fixing failure may occur in this region. In the case of the present embodiment, the control temperature of the image heating section $PR_{(4, 2)}$ is set 10° C. higher than other image heating sections to 240° C. As a result, even in the region of the less-than-5 mm end section on the side of the boundary position $B_{(4, 5)}$ of the image heating section $PR_{(4, 2)}$, the surface temperature of the fixing film 202 is higher than the temperature at which fixing failures do not occur, and a fixing failure did not occur.

In the case of Comparative Example 2, the control temperature of the non-image heating section $PP_{(5, 2)}$ is set to 230° C. that is similar to the image heating section. As a result, even in the region of the less-than-5 mm end section on the side of the boundary position $B_{(4, 5)}$ of the image heating section $PR_{(4, 2)}$, the surface temperature of the fixing film 202 is higher than the temperature at which fixing failures do not occur, and a fixing failure did not occur. Since more power than necessary is supplied from the perspective of the non-image heating section in Comparative Example 2, however, a power saving effect is reduced as compared to a case where the non-image heating section is heated at a lower temperature than the image heating section.

A power saving effect with respect to Comparative Example 2 due to the use of the heater control method according to the present embodiment will be described with reference to FIG. 8. FIG. 8 is a table showing power consumption by respective heating sections $H_{(i, j)}$ and a total thereof in the heating region $F_2$ according to Comparative Example 2 and the present embodiment in a case in which the image heating apparatus 200 according to the present example fixes a toner image of the recording material P, shown in FIG. 5, at the control temperature shown in FIG. 7A. Moreover, a multipurpose recording material (basis weight of 75 g/m$^2$, LETTER size) manufactured by HP was used as the recording material P. With the image heating apparatus 200 according to the present embodiment, a heating section with a control temperature of 120° C. requires a supply power of 47.9 W. In addition, a heating section with a control temperature of 230° C. requires a supply power of 59.6 W, and a heating section with a control temperature of 240° C. requires a supply power of 60.7 W. In the present embodiment, a total supply power of all heating sections in the heating region $F_2$ was 371.4 W. On the other hand, the supply power was 382.1 W in Comparative Example 2. The present embodiment produced a power saving effect of 10.7 W as compared to Comparative Example 2.

As described above, in the present embodiment, heating conditions of heat generating blocks provided in plurality in the longitudinal direction are adjusted in accordance with image information. Specifically, in accordance with a distance between a boundary position of a non-image heating section and an image heating section adjacent thereto and an image end section in the longitudinal direction, the heat generating quantity of an image heating section adjacent to the boundary position is changed. Accordingly, a further power saving effect can be produced while preventing occurrences of fixing failure and gloss decrease in a vicinity of an image end section.

Moreover, in the present embodiment, when both the condition $M_1$ and the condition $M_2$ described earlier are satisfied, a control temperature $T_{(i, j)}$ of a heating section $H_{(i, j)}$ is set such that $T_{(i, j)}=TR+\Delta T$. In this case, the predetermined distance need not necessarily be set to less than 5 mm, and the predetermined distance may be changed in accordance with a heat capacity of the image heating apparatus 200. In addition, while the predetermined amount $\Delta T$ is set to 10° C. in the present example, the predetermined amount $\Delta T$ need not necessarily be set to 10° C. if it can be ensured that the fixing film 202 does not fall below a temperature at which fixing failures do not occur. The predetermined amount $\Delta T$ can be increased in accordance with a decrease in the distance $X_{j(i-1, i)}$ or $X_{j(i, i+1)}$. For example, a method may be adopted in which the predetermined amount $\Delta T$ is increased such that $\Delta T$ is 0° C. when the distance $X_{j(i-1, i)}$ or $X_{j(i, i+1)}$ is 5 mm, $\Delta T$ is 4° C. when 3 mm, $\Delta T$ is 10° C. when 0 mm, and the like.

Figure 9:
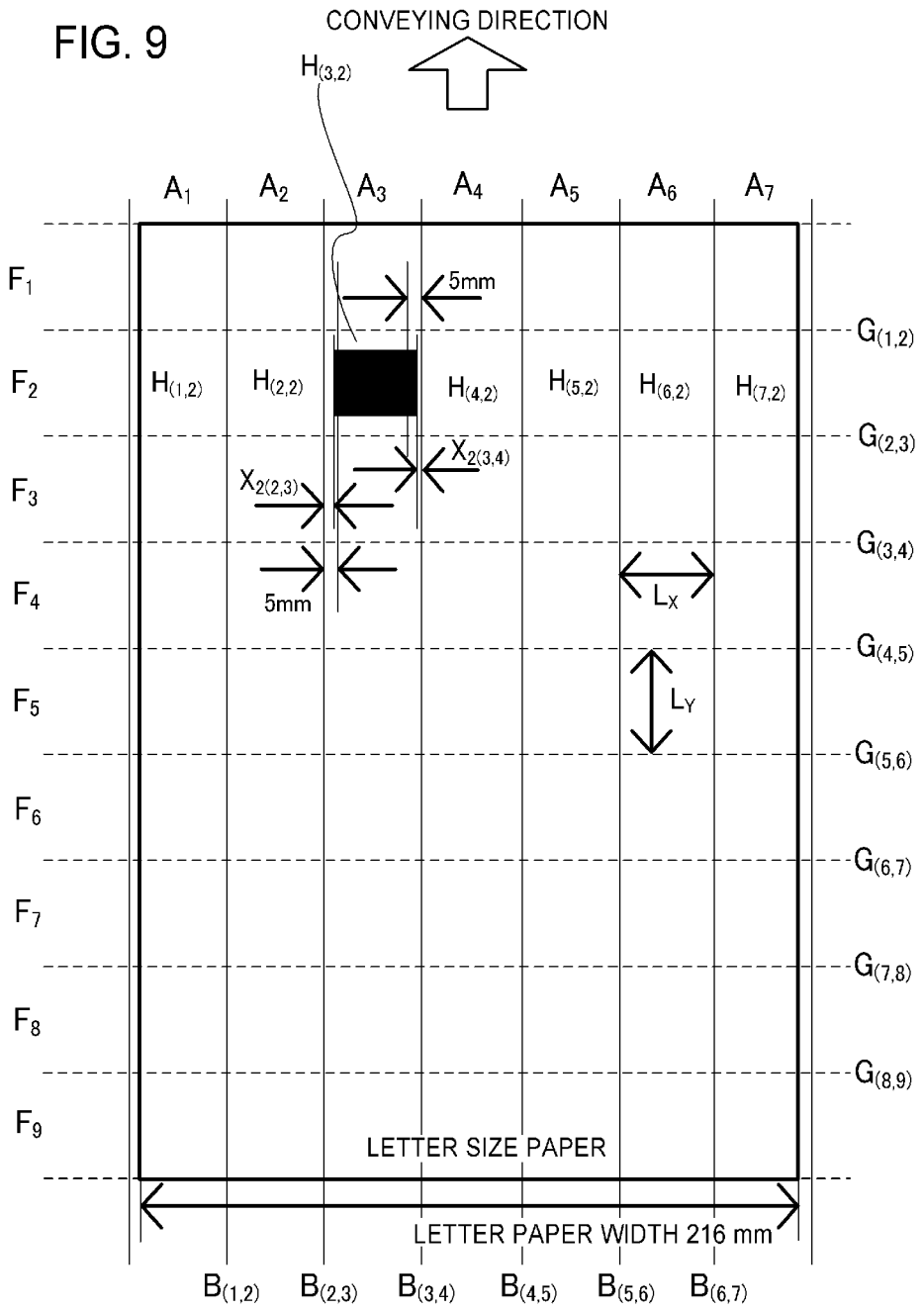
FIG. 9 is an explanatory diagram of a heating region of a heater according to Example 1.

FIG. 9 is a diagram for describing heater control when non-image heating sections are respectively adjacent to both sides of a single image heating section in Example 1. As shown in FIG. 9, when non-image heating sections PP exist adjacent to both sides of a single heating section $H_{(3, 2)}$, the predetermined amount $\Delta T$ can be increased in accordance with a decrease of a smaller distance between a distance $X_{2(2, 3)}$ and a distance $X_{2(3, 4)}$. In the case of FIG. 9, there is a relationship expressed as $X_{2(2, 3)}>X_{2(3, 4)}$. Therefore, the predetermined amount $\Delta T$ is to be changed in accordance with the distance $X_{2(3, 4)}$.

In addition, the image shown in FIG. 5 represents an example of images according to the present embodiment and images need not necessarily be continuous. The configuration of the present embodiment enables a similar effect to be produced even when respectively independent images exist in the heating section $H_{(2, 2)}$, $H_{(3, 2)}$, and $H_{(4, 2)}$. Furthermore, while the number of heating regions is described as seven in the longitudinal direction and nine in the conveying direction in the present embodiment, the configuration of the present embodiment is applicable as long as the number of heating regions is two or more in the longitudinal direction and one or more in the conveying direction. In addition, while a description of a heating region divided nine-ways in the conveying direction has been given in the present embodiment, the heating region may only be divided in a heater longitudinal direction and not divided in the conveying direction, in which case control temperatures may be changed in image units.

Furthermore, the predetermined amount $\Delta T$ can be made variable in accordance with a type of the recording material or a use environment. For example, when a thin paper with a basis weight of 60 g/m$^2$ is used as the recording material P, since an amount of heat necessary to fix a toner image decreases as compared to a case where ordinary paper is used, the temperature at which fixing failures do not occur becomes lower. Therefore, since the predetermined amount ΔT can be set smaller than in a case of ordinary paper, a further power saving effect can be produced depending on the type of the recording material.

In addition, instead of determining a heating amount of each heating section based on the control temperature, for example, the heating amount may be regulated by power supplied to the heater 300.

Example 2

Since configurations of the image forming apparatus 100, the image heating apparatus 200, the heater 300, and the heater control circuit according to Example 2 of the present invention are similar to those of Example 1, a description thereof will be omitted. Differences of Example 2 from Example 1 will now be mainly described. Matters not described in Example 2 are similar to those described in Example 1.

Example 2 differs from Example 1 in that the predetermined amount ΔT is changed in accordance with image density. Specifically, a toner amount conversion value representing a conversion of image density of each color obtained from CMKY image data received by the video controller 120 from a host computer into a toner amount is calculated for each image heating section. In addition, with respect to a heating section $H_{(i, j)}$ satisfying both the condition $M_1$ and the condition $M_2$ according to Example 1, control is performed to change the predetermined amount ΔT in accordance with a maximum value of the toner amount conversion value in a region less than 5 mm in the longitudinal direction from a boundary position with the non-image heating section.

Figure 10:
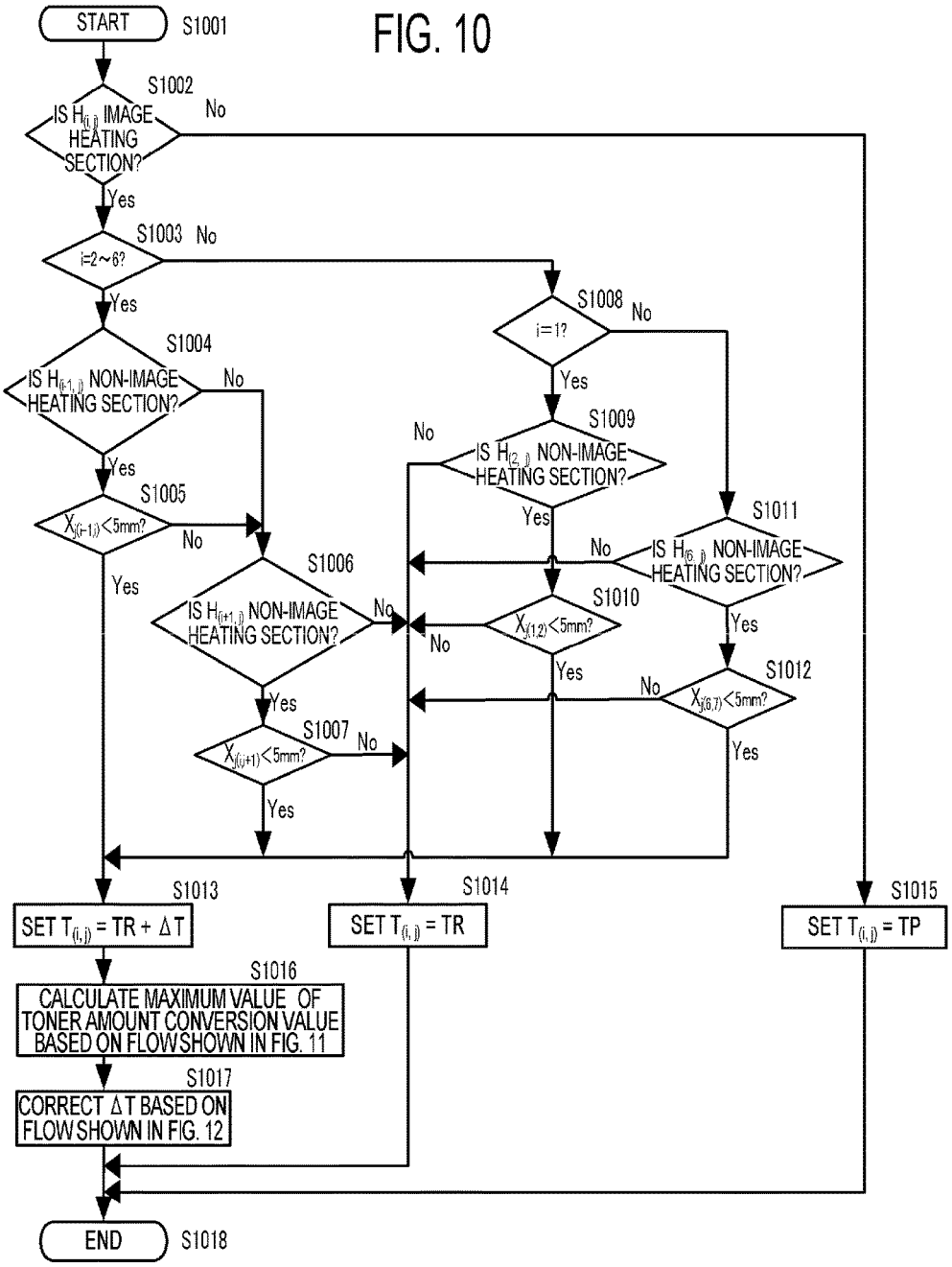
FIG. 10 is a flow chart showing a determination flow of a control temperature of a heating region according to Example 2.

FIG. 10 shows a determination flow of the control temperature $T_{(i, j)}$ of the heating section $H_{(i, j)}$ according to Example 2 of the present invention. When the determination flow is started in S1001, in S1002, a determination is made on whether or not the heating section $H_{(i, j)}$ is the image heating section PR. The determination flow proceeds to S1003 when it is determined that the heating section $H_{(i, j)}$ is the image heating section PR. On the other hand, when it is determined that the heating section $H_{(i, j)}$ is the non-image heating section PP instead of the image heating section PR, the determination flow proceeds to S1015, determines TP as the control temperature $T_{(i, j)}$, and proceeds to S1018.

In S1003, a determination is made on whether or not a number i of the heating section $H_{(i, j)}$, the control temperature of which is currently being determined, is any of 2 to 6. When i is any of 2 to 6, the determination flow proceeds to S1004. When i is not any of 2 to 6 and is 1 or 7, the determination flow proceeds to S1008.

In S1004, a determination is made on whether or not the heating section $H_{(i-1, j)}$ adjacent to the heating section $H_{(i, j)}$ is the non-image heating section PP. The determination flow proceeds to S1005 when it is determined that the heating section $H_{(i-1, j)}$ is the non-image heating section PP. On the other hand, the determination flow proceeds to S1006 when it is determined that the heating section $H_{(i-1, j)}$ is the image heating section PR instead of the non-image heating section PP.

In S1005, a determination is made on whether or not a distance $X_{j(i-1, i)}$ in the longitudinal direction between an end section of an image formed in the heating section $H_{(i, j)}$ on the side of the heating section $H_{(i-1, j)}$ and a boundary position $B_{(i-1, i)}$ is less than 5 mm. When it is determined that the distance $X_{j(1-1, j)}$ is less than 5 mm, the determination flow proceeds to S1013 to determine TR+ΔT as the control temperature $T_{(i, j)}$ of the heating section $H_{(i, j)}$, and subsequently proceeds to S1016. On the other hand, when it is determined that the distance $X_{j(i-1, i)}$ is not less than 5 mm, the determination flow proceeds to S1006.

In S1006, a determination is made on whether or not the heating section $H_{(i+1, j)}$ adjacent to the heating section $H_{(i, j)}$ is the non-image heating section PP. The determination flow proceeds to S1007 when it is determined that the heating section $H_{(i+1, j)}$ is the non-image heating section PP. On the other hand, when it is determined that the heating section $H_{(i+1, j)}$ is the image heating section PR instead of the non-image heating section PP, the determination flow proceeds to S1014, determines TR as the control temperature $T_{(i, j)}$ of the heating section $H_{(i, j)}$, and proceeds to S1018.

In S1007, a determination is made on whether or not a distance $X_{j(i, i+1)}$ in the longitudinal direction between an end section of an image formed in the heating section $H_{(i, j)}$ on the side of the heating section $H_{(i+1, j)}$ and a boundary position $B_{(i, i+1)}$ is less than 5 mm. When it is determined that the distance $X_{j(i, i+1)}$ is less than 5 mm, the determination flow proceeds to S1013 to determine TR+ΔT as the control temperature $T_{(i, j)}$ of the heating section $H_{(i, j)}$, and subsequently proceeds to S1016. On the other hand, when it is determined that the distance $X_{j(i, i+1)}$ is not less than 5 mm, the determination flow proceeds to S1014 to determine TR as the control temperature $T_{(i, j)}$ of the heating section $H_{(i, j)}$, and subsequently proceeds to S1018.

In S1008, a determination is made on whether or not the number i of the heating section $H_{(i, j)}$, the control temperature of which is currently being determined, is 1. When i is 1, the determination flow proceeds to S1009. When i is not 1 but 7, the determination flow proceeds to S1011.

In S1009, a determination is made on whether or not the heating section $H_{(2, j)}$ adjacent to the heating section $H_{(1, j)}$ is the non-image heating section PP. The determination flow proceeds to S1010 when it is determined that the heating section $H_{(2, j)}$ is the non-image heating section PP. On the other hand, when it is determined that the heating section $H_{(2, j)}$ is not the non-image heating section PP, the determination flow proceeds to S1014, determines TR as the control temperature $T_{(i, j)}$ of the heating section $H_{(i, j)}$, and proceeds to S1018.

In S1010, a determination is made on whether or not a distance $X_{j(1, 2)}$ in the longitudinal direction between an end section of an image formed in the heating section $H_{(1, j)}$ on the side of the heating section $H_{(2, j)}$ and the boundary position $B_{(1, 2)}$ is less than 5 mm. When it is determined that the distance $X_{j(1,2)}$ is less than 5 mm, the determination flow proceeds to S1013 to determine TR+ΔT as the control temperature $T_{(i, j)}$ of the heating section $H_{(i, j)}$, and subsequently proceeds to S1016. On the other hand, when it is determined that the distance $X_{j(1, 2)}$ is not less than 5 mm, the determination flow proceeds to S1014 to determine TR as the control temperature $T_{(i, j)}$ of the heating section $H_{(i, j)}$, and subsequently proceeds to S1018.

In S1011, a determination is made on whether or not the heating section $H_{(6, j)}$ adjacent to the heating section $H_{(7, j)}$ is the non-image heating section PP. The determination flow proceeds to S1012 when it is determined that the heating section $H_{(6, j)}$ is the non-image heating section PP. On the other hand, when it is determined that the heating section $H_{(6, j)}$ is not the non-image heating section PP, the determination flow proceeds to S1014, determines TR as the control temperature $T_{(i, j)}$ of the heating section $H_{(i, j)}$), and proceeds to S1018.

In S1012, a determination is made on whether or not a distance $X_{j(6,7)}$ in the longitudinal direction between an end section of an image formed in the heating section $H_{(7,j)}$ on the side of the heating section $H_{(6,j)}$ and the boundary position $B_{(6,7)}$ is less than 5 mm. When it is determined that the distance $X_{j(6,7)}$ is less than 5 mm, the determination flow proceeds to S1013 to determine TR+ΔT as the control temperature $T_{(i,j)}$ of the heating section $H_{(i,j)}$, and subsequently proceeds to S1016. On the other hand, when it is determined that the distance $X_{j(6,7)}$ is not less than 5 mm, the determination flow proceeds to S1014 to determine TR as the control temperature $T_{(i,j)}$ of the heating section $H_{(i,j)}$, and subsequently proceeds to S1018.

Figure 11:
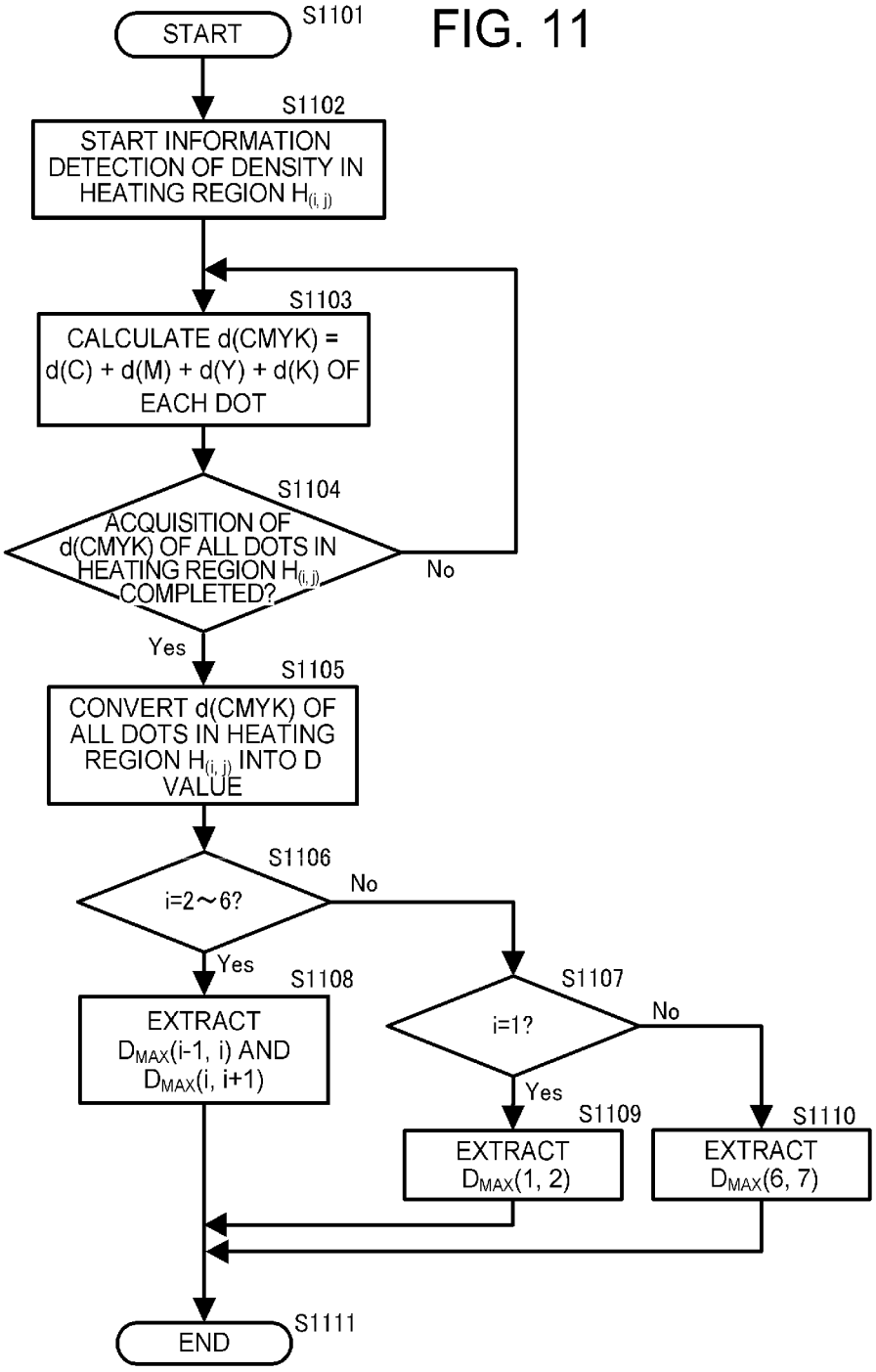
FIG. 11 is a flow chart showing an extraction flow of a maximum value of a toner amount conversion value according to Example 2.

In S1016, based on the determination flow shown in FIG. 11, with respect to the heating section $H_{(i,j)}$, a maximum value of a toner amount conversion value in a region less than 5 mm in the longitudinal direction from a boundary position with the non-image heating section is calculated.

Figure 12:
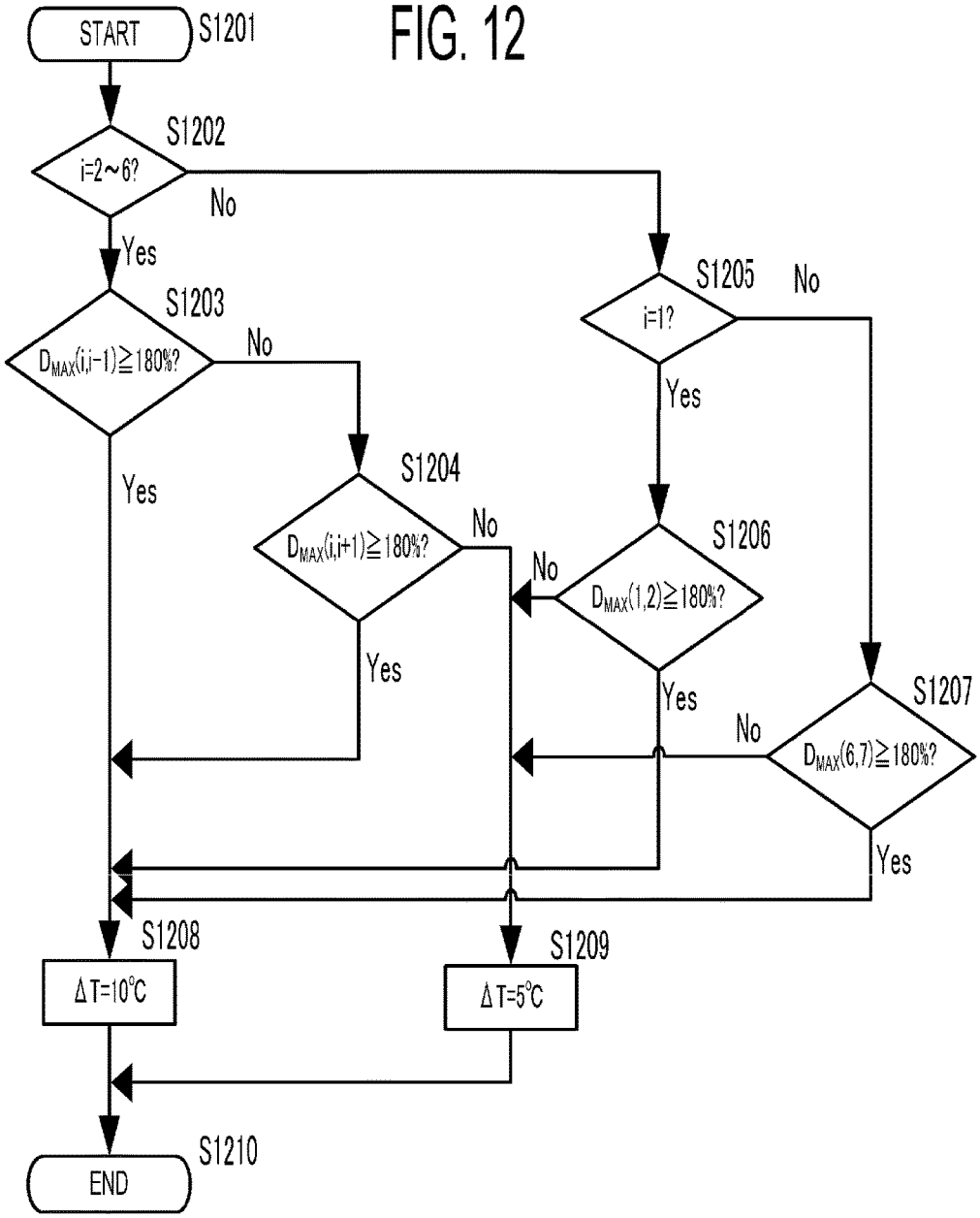
FIG. 12 is a flow chart showing a determination flow of a predetermined value ΔT according to Example 2.

In S1017, a value of the predetermined amount ΔT is determined based on the determination flow shown in FIG. 12, and the maximum value of the toner amount conversion value calculated in S1016.

In S1018, the determination flow of the control temperature $T_{(i,j)}$ of the heating section $H_{(i,j)}$ is ended.

An acquisition method of the maximum value of the toner amount conversion value in S1016 of the flow shown in FIG. 10 will now be described. Image data from an external apparatus, such as a host computer, is received by the video controller 120 of the image forming apparatus 100 and converted into bitmap data. Moreover, the number of pixels of the image forming apparatus 100 according to the present embodiment is 600 dpi, and the video controller 120 creates bitmap data (image density data for each color of CMYK) accordingly. The image forming apparatus 100 according to the present embodiment acquires image density of each color of CMKY for each dot from the bitmap data and converts the image density into a toner amount conversion value D. In the present embodiment, a maximum value $D_{MAX}(i-1, i)$ of the toner amount conversion value D in a region less than 5 mm in the longitudinal direction from a boundary position $B_{(i-1,i)}$ in the heating section $H_{(i,j)}$ (i=2 to 7) is acquired. In a similar manner, a maximum value $D_{MAX}(i, i+1)$ of the toner amount conversion value D in a region less than 5 mm in the longitudinal direction from a boundary position $B_{(i,i+1)}$ in the heating section $H_{(i,j)}$ (i=1 to 6) is acquired.

FIG. 11 is a diagram showing the flow described above, or, in other words, an extraction flow of a maximum value of a toner amount conversion value in a region less than 5 mm in the longitudinal direction from a boundary position. When the conversion into bitmap data is completed as described above, the flow starts from S1101. In S1102, detection of image density of each dot in the heating section $H_{(i,j)}$ is started. d(C), d(M), d(Y), and d(K) that denote image density of each color of C, M, Y, and K for each dot are obtained from image data having been converted into CMYK image data. In S1103, d(CMYK) that is a sum value thereof is calculated. This is performed for all dots in the heating section $H_{(i,j)}$ and, when acquisition of d(CMYK) with respect to all dots is confirmed in S1104, d(CMYK) is converted into the toner amount conversion value D in S1105.

In this case, image information in the video controller 120 is an 8-bit signal and image density d(C), d(M), d(Y), and d(K) for each single toner color is represented within a range of minimum density 00h to maximum density FFh. In addition, d(CMYK) that is a sum value thereof is a 2 byte and 8 bit signal. Moreover, d(CMYK) is a sum value of a plurality of toner colors and a maximum value of a toner amount conversion value may sometimes exceed 100%. In the image forming apparatus 100 according to the present embodiment, a toner amount on the recording material P is adjusted so as to have an upper limit of 1.15 mg/cm$^2$ (that corresponds to a value of the toner amount conversion value D of 230%) for a full solid image.

As described earlier, in S1105, the d(CMYK) value is converted into the toner amount conversion value D (%). Specifically, the conversion is performed for each single toner color so that the minimum image density 00h is expressed as 0% and the maximum toner amount FFh is expressed as 100%. The toner amount conversion value D (%) corresponds to an actual toner amount per unit area on the recording material P and, in the present embodiment, a toner amount of 0.50 mg/cm$^2$ on the recording material is equal to 100%.

In S1106, a determination is made on whether or not a number i of the heating region, the maximum value of the toner amount conversion value of which is currently being determined, is any of 2 to 6. When i is any of 2 to 6, the determination flow proceeds to S1108. When i is not any of 2 to 6 and is 1 or 7, the determination flow proceeds to S1107. In S1107, a determination is made on whether or not the number i of the heating region, the maximum value of the toner amount conversion value of which is currently being determined, is 1. When i is 1, the determination flow proceeds to S1109. When i is 7 instead of 1, the determination flow proceeds to S1110.

In S1108, a maximum value $D_{MAX}(i-1, i)$ (%) of the toner amount conversion value and a maximum value $D_{MAX}(i, i+1)$ (%) of the toner amount conversion value are extracted and, in S1111, the extraction flow is ended. In S1109, a maximum value $D_{MAX}(1, 2)$ (%) of the toner amount conversion value is extracted and, in S1111, the extraction flow is ended.

In S1110, a maximum value $D_{MAX}(6, 7)$ (%) of the toner amount conversion value is extracted and, in S1111, the extraction flow is ended.

Generally, with a solid image having a toner amount conversion value of 100% or higher, since image density on the recording material P is high and the larger the toner amount, the larger the amount of heat required to melt the toner, control temperature must be increased. In consideration thereof, in the present embodiment, when a heating section $H_{(i,j)}$ satisfies the condition $M_1$ and the condition $M_2$ according to Example 1, the predetermined amount ΔT is set to 10° C. when a maximum value of the toner amount conversion value of a region less than 5 mm in the longitudinal direction from a boundary position with a non-image heating section is 180% or higher. On the other hand, when a similar maximum value of the toner amount conversion value is lower than 180%, the predetermined amount ΔT is set to 5° C.

A determination flow (S1017) of the predetermined amount ΔT for the heating section $H_{(i,j)}$ according to Example 2 will be described with reference to FIG. 12. When the determination flow is started in S1201, in S1202, a determination is made on whether or not a number i of the heating region, of which ΔT is currently being determined, is any of 2 to 6. When i is any of 2 to 6, the determination flow proceeds to S1203. When i is not any of 2 to 6 and is 1 or 7, the determination flow proceeds to S1205.

In S1203, a determination is made on whether or not the maximum value $D_{MAX}(i-1, i)$ (%) of the toner amount conversion value is 180% or higher. When 180% or higher, the determination flow proceeds to S1208. When not 180% or higher, the determination flow proceeds to S1204.

In S1204, a determination is made on whether or not the maximum value $D_{MAX}(i, i+1)$ (%) of the toner amount conversion value is 180% or higher. When 180% or higher, the determination flow proceeds to S1208. When not 180% or higher, the determination flow proceeds to S1209.

In S1205, a determination is made on whether or not the number i of the heating region, of which ΔT is currently being determined, is 1. When i is 1, the determination flow proceeds to S1206. When i is not 1 but 7, the determination flow proceeds to S1207.

In S1206, a determination is made on whether or not the maximum value $D_{MAX}(1, 2)$ (%) of the toner amount conversion value is 180% or higher. When 180% or higher, the determination flow proceeds to S1208. When not 180% or higher, the determination flow proceeds to S1209.

In S1207, a determination is made on whether or not the maximum value $D_{MAX}(6, 7)$ (%) of the toner amount conversion value is 180% or higher. When 180% or higher, the determination flow proceeds to S1208. When not 180% or higher, the determination flow proceeds to S1209.

In S1208, ΔT is determined as 10° C. and, in S1210, the determination flow of ΔT is ended. In S1209, ΔT is determined as 5° C. and, in S1210, the determination flow of ΔT is ended.

Figure 13:
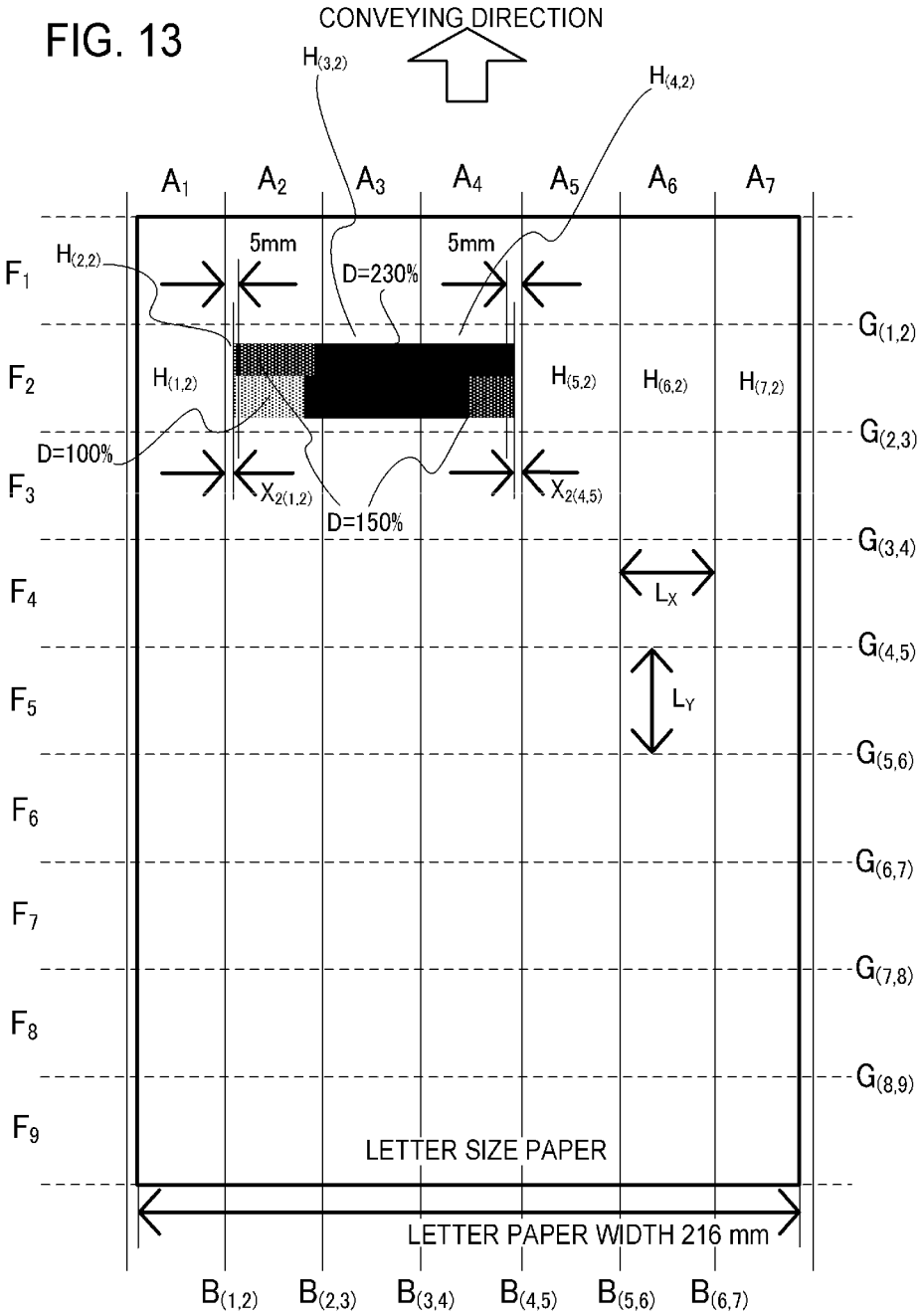
FIG. 13 is an explanatory diagram of a relationship between a heating region of a heater and an image according to Example 2.

Heater control according to the present embodiment will now be described in greater detail using the image shown in FIG. 13 as an example. FIG. 13 is a schematic diagram of the recording material P when images with toner amount conversion values of 100%, 150%, and 230% coexist on the recording material from a heating section $H_{(2, 2)}$ to a heating section $H_{(4, 2)}$, respectively, in the image forming apparatus 100 according to the present embodiment.

In the heating section $H_{(2, 2)}$, images with toner amount conversion values of 100%, 150%, and 230% coexist and a distance $X_{2(1, 2)}$ in the longitudinal direction between an end section of the images on a side of the heating section $H_{(1, 2)}$ and the boundary position $B_{(1, 2)}$ is less than 5 mm. In addition, a maximum value $D_{MAX}(1, 2)$ of the toner amount conversion value of a less-than-5 mm end section of the heating section $H_{(2, 2)}$ on the side of the boundary position $B_{(1, 2)}$ is 150%.

On the other hand, in the heating section $H_{(4, 2)}$, images with toner amount conversion values of 150% and 230% coexist and a distance $X_{2(4, 5)}$ in the longitudinal direction between an end section of the images on a side of the heating section $H_{(5, 2)}$ and the boundary position $B_{(4, 5)}$ is less than 5 mm. A maximum value $D_{MAX}(4, 5)$ of the toner amount conversion value of a less-than-5 mm end section of the heating section $H_{(4, 2)}$ on the side of the boundary position $B_{(4, 5)}$ is 230%.

Control temperature determination methods according to Example 2, Comparative Example 1, and Comparative Example 2 will now be described. First, in Example 2, a control temperature is determined using the determination flow of the control temperature $T_{(i, j)}$ of the heating section $H_{(i, j)}$ shown in FIG. 10. In addition, Comparative Example 1 represents a case in which the control temperature $T_{(i, j)}$ is determined by referring to Japanese Patent Application Laid-open No. H6-95540. In Comparative Example 1, the control temperature is uniformly set to TR when the heating section $H_{(i, j)}$ is the image heating section PR. In addition, Comparative Example 2 represents a case in which the control temperature $T_{(i, j)}$ is determined by referring to Japanese Patent Application Laid-open No. 2015-52722. In Comparative Example 2, a control temperature of the non-image heating section PP adjacent to the heating section $H_{(i, j)}$ is set to TR when the heating section $H_{(i, j)}$ satisfies both the condition $M_1$ and the condition $M_2$ described above.

Figure 14A:
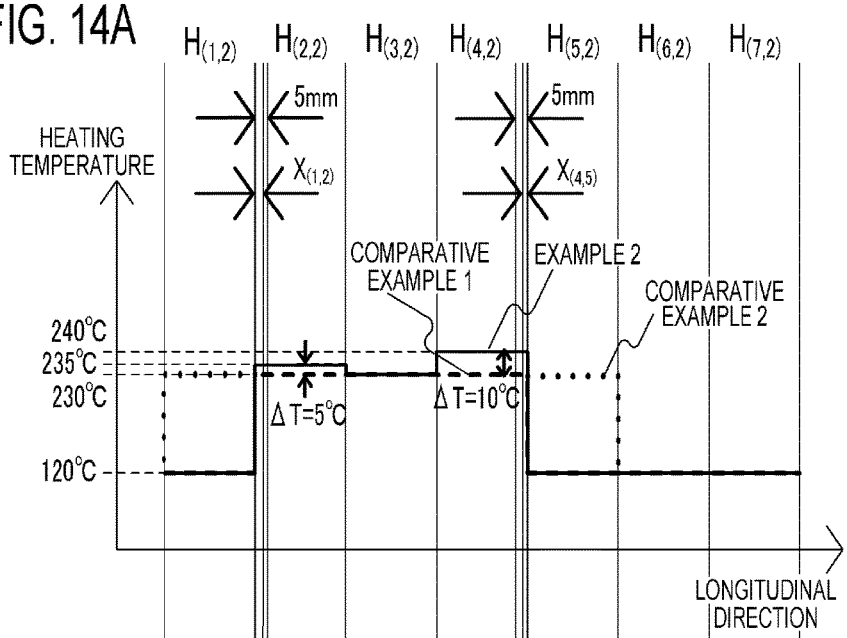
FIGS. 14A and 14B are diagrams showing a distribution in a longitudinal direction of a control temperature of a heating section and surface temperature of a fixing film.

FIG. 14A shows a distribution in the longitudinal direction of control temperatures in the heating region $F_2$. A solid line represents Example 2, in which the control temperatures of the heating sections $H_{(2, 2)}$, $H_{(3, 2)}$, and $H_{(4, 2)}$ as the image heating sections PR are respectively 235° C., 230° C., and 240° C., and the control temperature of the non-image heating sections is uniformly set to 120° C. With respect to the heating section $H_{(2, 2)}$, since a maximum value $D_{MAX}(1, 2)$ of the toner amount conversion value of a less-than-5 mm end section on the side of the boundary position $B_{(1, 2)}$ is 150%, the control temperature is set to a temperature that is higher than TR by a predetermined amount ΔT=5° C. In addition, with respect to the heating section $H_{(4, 2)}$, since a maximum value $D_{MAX}(4, 5)$ of the toner amount conversion value of a less-than-5 mm end section on the side of the boundary position $B_{(4, 5)}$ is 230%, the control temperature is set to a temperature that is higher than TR by a predetermined amount ΔT=10° C.

A dashed line in FIG. 14A represents Comparative Example 1, in which the control temperatures of the heating sections $H_{(2, 2)}$, $H_{(3, 2)}$, and $H_{(4, 2)}$ as the image heating sections PR are uniformly 230° C. In addition, control temperatures of the heating sections $H_{(1, 2)}$, $H_{(5, 2)}$, $H_{(6, 2)}$, and $H_{(7, 2)}$ as the non-image heating sections PP are uniformly 120° C. A dotted line in FIG. 14A represents Comparative Example 2, in which the control temperatures of the heating sections $H_{(2, 2)}$, $H_{(3, 2)}$, and $H_{(4, 2)}$ as image heating sections PR are uniformly 230° C. In addition, the control temperature of the heating sections $H_{(1, 2)}$ and $H_{(5, 2)}$ as the non-image heating sections PP is set to 230° C. that is the same as the image heating sections, and the control temperatures of the heating sections $H_{(6, 2)}$ and $H_{(7, 2)}$ as the other non-image heating sections PP are respectively set to 120° C. Furthermore, although not shown, heating regions other than the heating region $F_2$ are entirely constituted by non-image heating sections and control temperatures thereof are uniformly 120° C. in all of Example 2, Comparative Example 1, and Comparative Example 2.

Figure 14B:
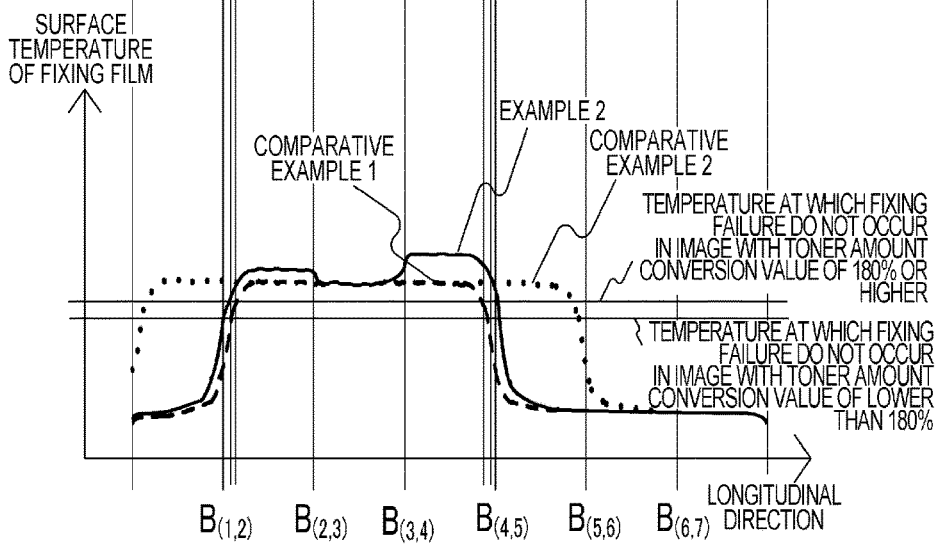

FIG. 14B shows a distribution in the longitudinal direction of surface temperatures of the fixing film 202 in the respective heating sections in the heating region $F_2$. A solid line represents a surface temperature of the fixing film 202 when each heating region of the recording material P is heated at the control temperature according to Example 2. A dashed line represents a surface temperature of the fixing film 202 according to Comparative Example 1, and a dotted line represents a surface temperature of the fixing film 202 according to Comparative Example 2.

In the case of Comparative Example 1, the surface temperature of the fixing film 202 is lower than a temperature at which fixing failures do not occur in an image with a toner amount conversion value of lower than 180% in a region of a less-than-5 mm end section on a side of the boundary position $B_{(1,2)}$ of the heating section $H_{(2, 2)}$ and in a region of a less-than-5 mm end section on a side of $B_{(4, 5)}$ of the image heating section $H_{(4, 2)}$. Since an image exists in the less-than-5 mm end sections on the side of the boundary position $B_{(1, 2)}$ of the heating section $H_{(2, 2)}$ and on the side of the boundary position $B_{(4, 5)}$ of the heating section $H_{(4, 2)}$, there is a possibility that a fixing failure may occur in this region.

In the case of the present embodiment, control temperatures of the heating sections $H_{(2, 2)}$ and $H_{(4, 2)}$ are set higher than PR by respectively 5° C. and 10° C. As a result, even in the region of the less-than-5 mm end section on the side of the boundary position $B_{(1, 2)}$ of the heating section $H_{(2, 2)}$, the surface temperature of the fixing film 202 is higher than the temperature at which fixing failures do not occur in an image with a toner amount conversion value of lower than 180%, and a fixing failure did not occur. In addition, even in the region of the less-than-5 mm end section on the side of the boundary position $B_{(4, 5)}$ of the heating section $H_{(4, 2)}$, the surface temperature of the fixing film 202 is higher than the temperature at which fixing failures do not occur in an image with a toner amount conversion value of 180% or higher, and a fixing failure did not occur.

In the case of Comparative Example 2, the control temperature of the heating sections $H_{(1, 2)}$ and $H_{(5, 2)}$ is set to 230° C. that is similar to the image heating section. As a result, even in the region of the less-than-5 mm end section on the side of the boundary position $B_{(1, 2)}$ of the heating section $H_{(2, 2)}$, the surface temperature of the fixing film 202 is higher than the temperature at which fixing failures do not occur in an image with a toner amount conversion value of lower than 180%, and a fixing failure did not occur. In addition, even in the region of the less-than-5 mm end section on the side of the boundary position $B_{(4, 5)}$ of the heating section $H_{(4, 2)}$, the surface temperature of the fixing film 202 is higher than the temperature at which fixing failures do not occur in an image with a toner amount conversion value of 180% or higher, and a fixing failure did not occur. Since more power than necessary is supplied from the perspective of the non-image heating section in the case of Comparative Example 2, however, a power saving effect declines as compared to a case in which the non-image heating section is heated at a lower temperature than the image heating section.

A power saving effect with respect to Comparative Example 2 due to the use of the heater control method according to the present embodiment will be described with reference to FIG. 15. FIG. 15 is a table showing power consumption by respective heating regions and a total thereof according to Comparative Example 2 and the present embodiment in a case in which the image heating apparatus according to the present embodiment fixes a toner image of the recording material P shown in FIG. 13. Moreover, a multipurpose recording material (basis weight of 75 g/m$^2$, LETTER size) manufactured by HP was used as the recording material P.

With the image heating apparatus according to the present example, a heating region with a control temperature of 120° C. requires a supply power of 47.9 W. In addition, a heating region with a control temperature of 230° C. requires a supply power of 59.6 W, a heating region with a control temperature of 235° C. requires a supply power of 60.2 W, and a heating region with a control temperature of 240° C. requires a supply power of 60.7 W. In the present embodiment, a total supply power of all heating sections in the heating region $F_2$ was 371.9 W. On the other hand, in Comparative Example 2, a total supply power of all heating sections was 393.9 W. The present embodiment produced a power saving effect of 21.9 W as compared to Comparative Example 2.

As described above, in Example 2, a power saving effect can be improved by changing the predetermined amount ΔT in accordance with density of an image. Moreover, in the description given above, the control temperature TR of an image heating section is set to 230° C. to enable an image with a toner amount conversion value of 230% to be fixed. The control temperature TR need not necessarily be set, however, so that an image with a toner amount conversion value of 230% can be fixed. The control temperature TR can be changed in accordance with a maximum value of the toner amount conversion value of an image in the image heating section as long as a surface temperature of the fixing film 202 exceeds a temperature at which fixing failures do not occur.

Figure 16:
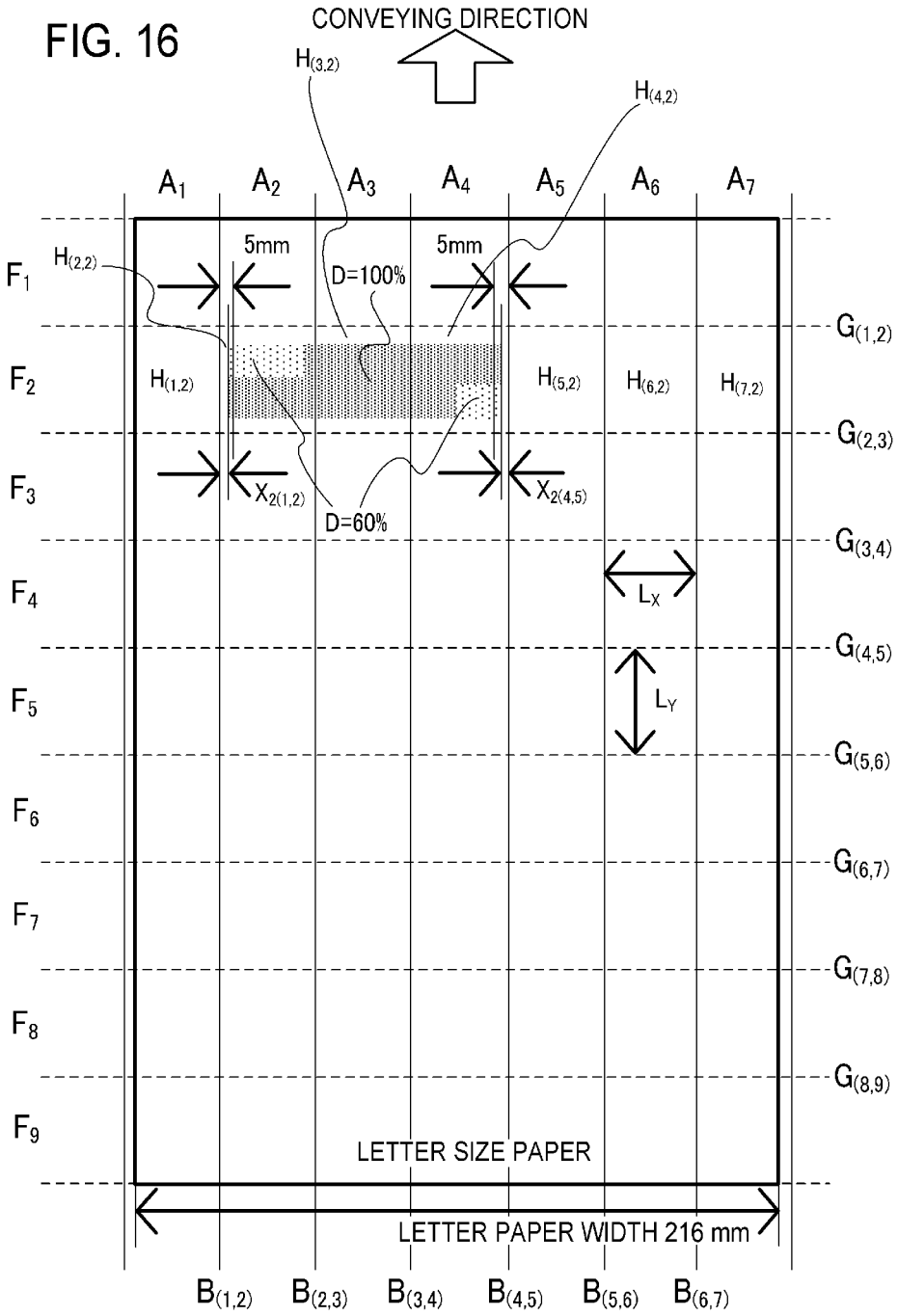
FIG. 16 is an explanatory diagram of a relationship between a heating region of a heater and an image according to Example 2.

FIG. 16 is a diagram showing the recording material P on which an image with a maximum toner amount conversion value of 100% is formed according to Example 2. For example, as shown in FIG. 16, when fixing an image with a maximum toner amount conversion value of 100%, the image can be fixed even when TR is set to 220° C. Accordingly, compared to setting the control temperature TR to 230° C., a further power saving effect can be expected.

In addition, while control is performed so that the predetermined amount ΔT is changed by a predetermined amount when the maximum value of the toner amount conversion value exceeds a predetermined threshold in the description given above, the predetermined amount ΔT need not necessarily be changed by a predetermined amount. For example, when the maximum value of the toner amount conversion value exceeds the predetermined threshold, the predetermined amount ΔT may be increased such that, the larger the maximum value of the toner amount conversion value, the larger the amount by which the predetermined amount ΔT is increased.

Furthermore, with respect to a heating section $H_{(i, j)}$, the predetermined amount ΔT may be changed in accordance with a minimum value instead of a maximum value of a toner amount conversion value in a region less than 5 mm in the longitudinal direction from a boundary position with a non-image heating section. For example, with respect to a halftone image of which the minimum value of the toner amount conversion value D (%) in the region is lower than 100%, the predetermined amount ΔT may be changed when the minimum value falls below 50%. This is because, in the case of a halftone image of which the toner amount conversion value D (%) is lower than 100%, since image density on the recording material P is low and the smaller the toner amount, the higher the degree of isolation among toner particles and the higher degree of inhibition of heat transfer among the toner particles, the control temperature needs to be set higher.

In addition, while a method of calculating the toner amount conversion value D (%) in accordance with image density information of each color toner has been described above, a correction can also be performed in accordance with an image type. With an image forming apparatus adopting an electrophotographic system, particularly when forming a horizontal line image, a phenomenon occurs in which, when a line width is made narrower (for example, a line width of 20 dots or less), a toner amount per unit area on the recording material increases. This is a well-known phenomenon that occurs when forming such a line image, in which creeping of an electric field at a developing portion causes toner to be developed in a concentrated manner.

In consideration of the phenomenon described above, for example, the toner amount conversion value D (%) of each dot in a horizontal line image portion with a line width of 20 dots or less can be corrected so as to exceed the toner amount conversion value D (%) of each dot in other portions (for example, multiply by 1.5 when line width is 10 dots). Since an actual toner amount on the recording material can be predicted with higher accuracy by performing such a correction corresponding to image width information, a predetermined amount ΔT that is more appropriate can be used.

Furthermore, the configuration described above is one example of the configuration of the present embodiment, and the toner amount conversion value D (%) of all dots need not necessarily be detected. For example, the following method described in Japanese Patent Application Laid-open No. 2013-41118 may be used. Specifically, an image formation region is virtually divided into regions with a size set in advance (for example, 20×20 dots), and image density information for at least one to several points is picked up as a representative value from image data corresponding to one region. The image density information is converted into the toner amount conversion value D (%) and referred to, and may be used as a basis for determining the predetermined amount ΔT. Alternatively, the predetermined amount ΔT may be determined based on a ratio between dots on which an image is formed and dots on which an image is not formed in a region with a size set in advance (for example, 20×20 dots).

According to the present invention, a further power saving effect can be produced while suppressing occurrences of fixing failure and gloss decrease in a vicinity of an image end section.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed:

1. An image heating apparatus that heats an image formed on a recording material, the image heating apparatus comprising:

a first heat generating element;

a second heat generating element that is arranged adjacent to the first heat generating element in a direction orthogonal to a conveying direction of the recording material; and a control portion that controls power supplied to the first and second heat generating elements, the control portion being capable of individually controlling the first and second heat generating elements, the first and second heat generating elements being respectively controlled so as to maintain a control temperature, wherein, when an image exists in a second region on the recording material heated by the second heat generating element, and an image does not exist in a first region on the recording material heated by the first heat generating element, the control portion sets a difference of the control temperatures of the first and second heat generating elements, when heating the second region, in accordance with a distance between an end section of the image in the second region and a boundary of the first region and the second region.

2. The image heating apparatus according to claim 1, wherein, when an image exists in the second region on the recording material heated by the second heat generating element, and an image does not exist in the first region on the recording material heated by the first heat generating element, and when the distance between the end section of the image in the second region and the boundary of the first region and the second region is less than a predetermined distance, the control portion sets the difference when heating the second region to a difference that is greater than a difference set in a case in which the distance is greater than the predetermined distance.

3. The image heating apparatus according to claim 2, wherein the control portion further sets the difference when heating the second region in accordance with a density of the image existing in the second region.

4. The image heating apparatus according to claim 3, wherein the control portion sets the difference when heating the second region in accordance with a density of an image existing between the boundary and a position separated from the boundary by the predetermined distance in the second region.

5. The image heating apparatus according to claim 4, wherein the control portion sets the difference when heating the second region such that, the greater the density of the image existing between the boundary and the position separated from the boundary by the predetermined distance, the greater the difference.

6. The image heating apparatus according to claim 1, further comprising a third heat generating element that is adjacent to the second heat generating element in the direction orthogonal to the conveying direction and that is controllable independently of the first and second heat generating elements, wherein, when an image exists in the second region, and an image does not exist in either one of the first region and a third region on the recording material heated by the third heat generating element, the control portion sets the difference when heating the second region based on a length that is the lesser of the distance between the end section of the image in the second region and the boundary of the first region and the second region, and a distance between the end section of the image in the second region and a boundary of the second region and the third region.

7. The image heating apparatus according to claim 1, further comprising:

a tubular film; and a heater that is in contact with an inner surface of the film, the heater including the first and second heat generating elements, wherein the image on the recording material is heated by heat from the heater through the film.

8. An image forming apparatus comprising:

an image forming portion that forms an image on a recording material; and a fixing portion that fixes the image formed on the recording material to the recording material, wherein the fixing portion is the image heating apparatus according to claim 1.

9. The image heating apparatus according to claim 7, wherein the heater includes a substrate, and the first and second heat generating elements are mounted on the substrate.

10. An image heating apparatus that heats an image formed on a recording material, the image heating apparatus comprising:

a heater including a substrate and a plurality of heat generating blocks provided on the substrate, the plurality of heat generating blocks being arranged along a longitudinal direction of the heater, and including a first heat generating block and a second heat generating block that is arranged adjacent to the first heat generating block in the longitudinal direction of the heater; and a control portion that controls power supplied to the plurality of the heat generating blocks, the control portion being capable of individually controlling the plurality of heat generating blocks, the first and second heat generating blocks being respectively controlled so as to maintain a control temperature, wherein, when an image exists in a second region on the recording material heated by the second heat generating block, and an image does not exist in a first region on the recording material heated by the first heat generating block, the control portion sets a difference of the control temperatures of the first and second heat generating block when heating the second region in accordance with a distance between an end section of the image in the second region and a boundary of the first region and the second region.

11. The image heating apparatus according to claim 10, wherein, when an image exists in the second region on the recording material heated by the second heat generating block, and an image does not exist in the first region on the recording material heated by the first heat generating block, and when the distance between the end section of the image in the second region and the boundary of the first region and the second region is less than a predetermined distance, the control portion sets the difference when heating the second region to a difference that is greater than a difference set in a case in which the distance is greater than the predetermined distance.

12. The image heating apparatus according to claim 11, wherein the control portion further sets the difference when heating the second region in accordance with a density of the image existing in the second region.

13. The image heating apparatus according to claim 12, wherein the control portion sets the difference when heating the second region in accordance with a density of an image existing between the boundary and a position separated from the boundary by the predetermined distance in the second region.

14. The image heating apparatus according to claim 13, wherein the control portion sets the difference when heating the second region such that, the greater the density of the image existing between the boundary and the position separated from the boundary by the predetermined distance, the greater the difference.

15. The image heating apparatus according to claim 10, wherein the plurality of the heat generating blocks further includes a third heat generating block that is adjacent to the second heat generating block in the longitudinal direction of the heater and that is controllable independently of the first and second heat generating blocks, and wherein, when an image exists in the second region, and an image does not exist in either one of the first region and a third region on the recording material heated by the third heat generating block, the control portion sets the difference when heating the second region based on a length that is the lesser of the distance between the end section of the image in the second region and the boundary of the first region and the second region, and a distance between the end section of the image in the second region and a boundary of the second region and the third region.

16. The image heating apparatus according to claim 10, further comprising a tubular film, the heater being in contact with an inner surface of the film, wherein the image on the recording material is heated by heat from the heater through the film.

17. An image forming apparatus comprising:

an image forming portion that forms an image on a recording material; and a fixing portion that fixes the image formed on the recording material to the recording material, wherein the fixing portion is the image heating apparatus according to claim 10.

* * * * *